US010017699B2

(12) United States Patent
Moran

(10) Patent No.: US 10,017,699 B2
(45) Date of Patent: Jul. 10, 2018

(54) PROCESS FOR RECOVERING BITUMEN FROM FROTH TREATMENT TAILINGS

(71) Applicant: Kevin Moran, Edmonton (CA)

(72) Inventor: Kevin Moran, Edmonton (CA)

(73) Assignee: TITANIUM CORPORATION INC. (CA)

( * ) Notice: Subject to any disclaimer, the term of this patent is extended or adjusted under 35 U.S.C. 154(b) by 61 days.

(21) Appl. No.: 15/184,625

(22) Filed: Jun. 16, 2016

(65) Prior Publication Data

US 2017/0335200 A1 Nov. 23, 2017

Related U.S. Application Data

(60) Provisional application No. 62/337,996, filed on May 18, 2016.

(51) Int. Cl.
*C10G 1/04* (2006.01)

(52) U.S. Cl.
CPC ..... *C10G 1/047* (2013.01); *C10G 1/045* (2013.01)

(58) Field of Classification Search
CPC ..... C10G 1/04; C10G 1/045; C10G 1/047
See application file for complete search history.

(56) References Cited

U.S. PATENT DOCUMENTS 3,553,099 A 1/1971 Savage et al.
3,594,306 A 7/1971 Dobson
3,990,885 A 11/1976 Baillie et al.
4,460,452 A 7/1984 Johnson et al.
6,358,403 B1 3/2002 Brown et al.
(Continued)

FOREIGN PATENT DOCUMENTS

CA 1013696 7/1977
CA 2021185 9/1998
(Continued)

OTHER PUBLICATIONS

Titanium Corporation (Oct. 2015), Remediating Oil Sands Froth Treatment Tailings to Reduce Environmental Impacts and Create Economic Growth and Diversification for Alberta: Titanium Corporation's Submission to the AER Tailings Management Framework, 26 pp.

*Primary Examiner* — Brian A McCaig
(74) *Attorney, Agent, or Firm* — Kirsten M. Oates; Rodman & Rodman LLP

(57) ABSTRACT

A method for processing a froth treatment tailings separated from a bitumen froth produced in a process for recovering bitumen from oil sand ore, includes subjecting the froth treatment tailings to a first solvent extraction process to produce a first extract including bitumen, and a first raffinate, subjecting the first raffinate to a separation process to produce a fine mineral material fraction including fine solid mineral material having a particle size less than 44 microns and a coarse mineral material fraction including a coarse mineral material having a particle size equal to or greater than 44 microns, subjecting the coarse mineral material fraction to a froth flotation process to produce a heavy mineral concentrate and a coarse mineral material tailings, and subjecting the heavy mineral concentrate to a second solvent extraction process to produce a second extract including bitumen and a second raffinate including a debitumenized heavy mineral concentrate.

10 Claims, 8 Drawing Sheets

(56) References Cited

U.S. PATENT DOCUMENTS

| | | | | |
|---|---|---|---|---|
| 7,695,612 | B2 | 4/2010 | Erasmus et al. | |
| 7,998,342 | B2 | 8/2011 | Duyvesteyn et al. | |
| 8,096,425 | B2 | 1/2012 | Bjornson et al. | |
| 8,382,976 | B2 | 2/2013 | Moran et al. | |
| 8,852,429 | B2 | 10/2014 | Moran et al. | |
| 9,314,713 | B2 | 4/2016 | Moran et al. | |
| 2005/0150844 | A1 | 7/2005 | Hyndman et al. | |
| 2007/0209971 | A1 | 9/2007 | Duyvesteyn et al. | |
| 2007/0272596 | A1* | 11/2007 | Erasmus ..... | B03D 1/02 208/400 |
| 2008/0099380 | A1 | 5/2008 | Lahaie et al. | |
| 2011/0278202 | A1 | 11/2011 | Moran et al. | |
| 2012/0000831 | A1 | 1/2012 | Moran et al. | |
| 2015/0247094 | A1 | 9/2015 | Moran et al. | |

FOREIGN PATENT DOCUMENTS

| | | |
|---|---|---|
| CA | 2573633 | 7/2008 |
| CA | 2682109 | 1/2010 |
| CA | 2755637 | 4/2012 |

* cited by examiner

First solvent extraction process (40)

| Stream Number | 20 | | 42/64 | | 64 | | 70 | | 66 | | 44/68 | |
|---|---|---|---|---|---|---|---|---|---|---|---|---|
| Stream Description | froth treatment tailings | | first extract / first solvent extraction stage overflow product | | first solvent extraction stage underflow product | | hydrocarbon diluent | | second solvent extraction stage overflow product | | first rafffinate / second solvent extraction stage underflow product | |
| Component | % | Mass | % | Mass | % | Mass | % | Mass | % | Mass | % | Mass |
| Naphtha | 0.20 | 0.01 | 83.10 | 1.89 | 11.48 | 0.63 | 100.00 | 2.50 | 90.52 | 2.51 | 11.86 | 0.62 |
| Bitumen | 8.00 | 0.40 | 16.16 | 0.37 | 2.75 | 0.15 | 0.00 | | 4.28 | 0.12 | 0.62 | 0.03 |
| Water | 76.30 | 3.82 | 0.50 | 0.01 | 71.68 | 3.94 | 0.00 | | 5.00 | 0.14 | 72.80 | 3.80 |
| Solids | 15.50 | 0.78 | 0.30 | 0.01 | 14.09 | 0.78 | 0.00 | | 0.20 | 0.01 | 14.73 | 0.77 |
| Total flow | 100.00 | 5.00 | 100.06 | 2.28 | 100.00 | 5.50 | 100.00 | 2.50 | 100.00 | 2.78 | 100.00 | 5.23 |
| S/F | 0.32 | | | | | | | | | | | |
| N/B | | | 5.1 | | | | | | 21.1 | | | |

Figure 2A

Separation process (80)

| Stream Number | 44/68 | | 84 | | 82 | |
|---|---|---|---|---|---|---|
| Stream Description | first rafffinate / second solvent extraction stage underflow product | | fine mineral material fraction | | coarse mineral material fraction | |
| Component | % | Mass | % | Mass | % | Mass |
| Naphtha | 11.86 | 0.62 | 16.11 | 0.40 | 7.96 | 0.22 |
| Bitumen | 0.62 | 0.03 | 0.39 | 0.01 | 0.83 | 0.02 |
| Water | 72.80 | 3.80 | 75.81 | 1.90 | 70.03 | 1.91 |
| Solids | 14.73 | 0.77 | 7.69 | 0.19 | 21.18 | 0.58 |
| Total flow | 100.00 | 5.23 | | 2.50 | | 2.73 |
| THM | 25.18 | 0.19 | | 0.000969 | 33.41 | 0.19 |

Figure 2B

Froth flotation process (100)

| Stream Number | 82 | | 114 | | 116 | | 118 | | 120 | | 102 | |
|---|---|---|---|---|---|---|---|---|---|---|---|---|
| Stream Description | coarse mineral material fraction | | rougher stage float product | | rougher stage sink product | | scavenger stage float product | | scavenger stage sink product | | heavy mineral concentrate | |
| Component | % | Mass | % | Mass | % | Mass | % | Mass | % | Mass | % | Mass |
| Naphtha | 7.96 | 0.22 | 11.25 | 0.15 | 4.82 | 0.07 | 28.94 | 0.04 | 1.77 | 0.02 | 13.02 | 0.20 |
| Bitumen | 0.83 | 0.02 | 1.18 | 0.02 | 0.50 | 0.01 | 6.67 | 0.01 | 0.09 | 0.00 | 1.44 | 0.02 |
| Water | 70.03 | 1.91 | 65.75 | 0.89 | 75.73 | 1.02 | 51.88 | 0.08 | 76.96 | 0.94 | 64.36 | 0.96 |
| Solids | 21.18 | 0.58 | 21.82 | 0.29 | 20.96 | 0.28 | 15.40 | 0.02 | 21.18 | 0.26 | 21.18 | 0.32 |
| Total flow | | 2.73 | | 1.35 | | 1.38 | | 0.15 | | 1.23 | | 1.50 |
| THM | 33.41 | 0.19 | 70.00 | 0.20602 | | | | | | | 54.66419 | 0.173503 |

Figure 2C

Second solvent extraction process (120)

| Stream Number | 102 | | 132 | | 124/138 | | 136 | |
|---|---|---|---|---|---|---|---|---|
| Stream Description | heavy mineral concentrate | | first solvent extraction stage feed material | | second extract / first solvent extraction stage overflow component | | first solvent extraction stage underflow component | |
| Component | % | Mass | % | Mass | % | Mass | % | Mass |
| Naphtha | 13.02 | 0.20 | 28.82 | 0.60 | 94.96 | 0.44 | 10.12 | 0.16 |
| Bitumen | 1.44 | 0.02 | 1.34 | 0.03 | 4.24 | 0.02 | 0.48 | 0.01 |
| Water | 64.36 | 0.96 | 53.20 | 1.10 | 0.50 | 0.01 | 68.25 | 1.09 |
| Solids | 21.18 | 0.32 | 16.64 | 0.35 | 0.30 | 0.01 | 21.15 | 0.34 |
| Total flow | 100.00 | 1.50 | 100.00 | 2.07 | 100.00 | 0.47 | 100.00 | 1.60 |
| Asphaltenes | 50 | 0.01 | | | | | | |
| THM | 25 | 0.08 | | | | | | |
| S/F | 0.200167 | | | | | | | |
| N/B | | | 21.52889 | | 22.41464 | | 21.08914 | |
| B/S | 6.787272 | | 8.042829 | | | | 2.270019 | |

Second solvent extraction process (120) (continued)

| Stream Number | 150 | | 148 | | 170 | | 162 | | 122/160 | |
|---|---|---|---|---|---|---|---|---|---|---|
| Stream Description | second solvent extraction stage overflow component | | second solvent extraction stage underflow component | | hydrocarbon diluent | | third solvent extraction stage overflow component | | debitumenized heavy mineral concentrate / third solvent extraction stage underflow component | |
| Component | % | Mass | % | Mass | % | Mass | % | Mass | % | Mass |
| Naphtha | 93.35 | 0.4025 | 10.37 | 0.15 | 100.00 | 0.30 | 93.91 | 0.3899 | 4.49 | 0.06 |
| Bitumen | 0.65 | 0.00622 | 0.08 | 0.00 | 0.00 | | 0.59 | 0.0025 | 0.03 | 0.00 |
| Water | 5.00 | 0.1388 | 67.64 | 0.97 | 0.00 | | 5.00 | 0.0208 | 71.96 | 0.95 |
| Solids | 1.00 | 0.0278 | 21.91 | 0.31 | 0.00 | | 0.50 | 0.0021 | 23.53 | 0.31 |
| Total flow | 100.00 | 0.58 | 100.00 | 1.44 | 100.00 | 0.30 | 100.00 | 0.4152 | 100.00 | 1.32 |
| Asphaltenes | | | | | 25.37974 | 0.07935 | | | | |
| THM | | | | | | | | | | |
| S/F | | | | | | | | | | |
| N/B | 142.7522 | | 138.324 | | | | 158.7736 | | 160.352 | |
| B/S | | | 0.342327 | | | | | | 0.11902 | |

Figure 2D

First diluent recovery process (180)

| Stream Number | 84 & 104 / 182 | | 186 | | 184 | |
|---|---|---|---|---|---|---|
| Stream Description | fine mineral material fraction & coarse mineral material tailings ("first intermediate product") | | first recovered diluent | | first diluent recovered intermediate product | |
| Component | % | Mass | % | Mass | % | Mass |
| Naphtha | 10.85 | 0.42 | 45.05 | 0.42 | 0.08 | 0.00 |
| Bitumen | 0.28 | 0.01 | 0.00 | 0.00 | 0.30 | 0.01 |
| Water | 72.56 | 2.84 | 54.95 | 0.52 | 83.91 | 2.41 |
| Solids | 11.55 | 0.45 | 0.00 | 0.00 | 15.71 | 0.45 |
| Steam | 4.76 | 0.19 | | | | |
| Total flow | 100.00 | 3.91 | 100.00 | 0.94 | 100.00 | 2.88 |

Figure 2E

Second diluent recovery process (188)

| Stream Number | 122/190 | | 192 | | 191 | |
|---|---|---|---|---|---|---|
| Stream Description | debitumenized heavy metal concentrate ("second intermediate product") | | second recovered diluent | | second diluent recovered intermediate product | |
| Component | % | Mass | % | Mass | % | Mass |
| Naphtha | 4.24 | 0.06 | 37.42 | 0.06 | 0.08 | 0.00 |
| Bitumen | 0.10 | 0.00 | 0.00 | 0.00 | 0.07 | 0.00 |
| Water | 67.88 | 0.95 | 62.58 | 0.10 | 74.11 | 0.89 |
| Solids | 22.12 | 0.31 | 0.00 | 0.00 | 25.74 | 0.31 |
| Steam | 5.66 | 0.08 | | | | |
| Total flow | 100.00 | 1.40 | 100.00 | 0.16 | 100.00 | 1.21 |

Figure 2F

Water recovery process (194)

| Stream Number | 184 | | 196 | | 198 | |
|---|---|---|---|---|---|---|
| Stream Description | diluent recovered intermediate product | | recovered water portion | | thickened slurry | |
| Component | % | Mass | % | Mass | % | Mass |
| Naphtha | 0.00 | 0.00 | 0.00 | 0.00 | 0.00 | 0.00 |
| Bitumen | 0.35 | 0.01 | 0.00 | 0.00 | 1.15 | 0.01 |
| Water | 83.68 | 2.41 | 99.80 | 1.93 | 51.27 | 0.48 |
| Solids | 15.63 | 0.45 | 0.20 | 0.00 | 47.58 | 0.45 |
| Total flow | 100.00 | 2.88 | 100.00 | 1.94 | 100.00 | 0.94 |

Figure 2G

PROCESS FOR RECOVERING BITUMEN FROM FROTH TREATMENT TAILINGS

TECHNICAL FIELD

The present invention relates to oil sands, more particularly to processes and systems for recovering bitumen, heavy minerals, and water from froth treatment tailings.

BACKGROUND OF THE INVENTION

Oil Sand Ore

Oil sand ore is essentially comprised of a matrix of bitumen, solid mineral material and water.

The bitumen component of oil sand ore includes hydrocarbons which are typically quite viscous at normal in situ temperatures and which act as a binder for the other components of the oil sand. For example, bitumen has been defined by the United Nations Institute for Training and Research as a hydrocarbon with a viscosity greater than $10^4$ mPa·s (at deposit temperature) and a density greater than 1000 kg/$m^3$ at 15.6 degrees Celsius.

The solid mineral material component of oil sand ore typically consists of sand, rock, silt and clay. Solid mineral material may be present its oil sand ore as coarse solid mineral material or fine solid mineral material. The accepted division between coarse solid mineral material and fine solid mineral material is typically a particle size of about 44 microns. Solid mineral material having a particle size greater than about 44 microns is typically considered to be coarse solid mineral material, while solid mineral material having a particle size less than about 44 microns is typically considered to be fine solid mineral material. Sand and rock are generally present in oil sand ore as coarse solid mineral material, while silt and clay are generally present in oil sand ore as fine solid mineral material.

A typical deposit of oil sand ore may contain (by weight) about 10 percent bitumen, up to about 6 percent water, with the remainder being comprised of solid mineral material, which may include a relatively small amount of impurities such as humic matter and heavy minerals.

Processing of Oil Sand Ore

Water-based technologies are typically used to extract bitumen from oil sand ore originating from the Athabasca area in northeastern Alberta, Canada. A variety of water based technologies exist, including the Clark "hot water" process and a variety of other processes which may use hot water, warm water or cold water in association with a variety of different separation apparatus.

In a typical water based oil sand extraction process, the oil sand ore is first mixed with water to form an aqueous slurry. The slurry is then processed to release bitumen from within the oil sand ore matrix and prepare the bitumen for separation from the slurry, thereby providing a conditioned slurry. The conditioned slurry is then processed in one or more separation apparatus which promote the formation of a primary bitumen froth while rejecting coarse solid mineral material and much of the fine solid mineral material and water. The separation apparatus may also produce a middlings stream from which a secondary bitumen froth may be scavenged. This secondary bitumen froth may be added to the primary bitumen froth or may be kept separate from the primary bitumen froth.

A typical bitumen froth (comprising a primary bitumen froth and/or a secondary bitumen froth) may contain (by weight) about 60 percent bitumen, about 30 percent water and about 10 percent solid mineral material, wherein a large proportion of the solid mineral material is fine solid mineral material. The bitumen which is present in a typical bitumen froth is typically comprised of both non-asphaltenic material and asphaltenes.

Processing of Bitumen Froth

This bitumen froth is typically subjected to a froth treatment process in order to reduce its solid mineral material and wafer concentration by separating the bitumen froth into a bitumen product and froth treatment tailings.

In a typical froth treatment process, the bitumen froth is diluted with a froth treatment diluent to provide a density gradient between the hydrocarbon phase and the water phase and to lower the viscosity of the hydrocarbon phase. The diluted bitumen froth is then subjected to separation in one or more separation apparatus in order to produce the bitumen product and the froth treatment tailings. Exemplary separation apparatus include gravity settling vessels, inclined plate separators and centrifuges.

Some commercial froth treatment processes use naphthenic type diluents (defined as froth treatment diluents which consist of or contain a significant amount of one or more aromatic compounds). Examples of naphthenic type diluents include toluene (a light aromatic compound) and commercial naphtha, which may be comprised of both aromatic and non-aromatic compounds. Froth treatment processes which use naphthenic type diluents (i.e., naphthenic processes) typically result in a relatively high bitumen recovery (perhaps about 98 percent), but also typically result in a bitumen product which has a relatively high solid mineral material and water concentration (also described as "bottom sediment and water concentration" or "BS&W content").

Other commercial froth treatment processes use paraffinic type diluents (defined as froth treatment diluents which consist of or contain, significant amounts of one or more relatively short-chained aliphatic compounds). Examples of paraffinic type diluents are $C_4$ to $C_8$ aliphatic compounds and natural gas condensate, which typically contains short-chained aliphatic compounds and may also contain small amounts of aromatic compounds. Froth treatment processes which use paraffinic type diluents (i.e., paraffinic processes) typically result in a relatively lower bitumen recovery (in comparison with naphthenic processes), and in a bitumen product which has a relatively lower basic sediment and water (BS&W) content (in comparison with naphthenic processes). Both the relatively lower bitumen recovery and the relatively lower BS&W content may be attributable to the phenomenon of asphaltene precipitation, which occurs in paraffinic processes when the concentration of the paraffinic type diluent exceeds a critical level. This asphaltene precipitation results in bitumen being lost to the froth treatment tailings, but also provides a cleaning effect in which the precipitating asphaltenes trap solid mineral material and water as they precipitate, thereby separating the solid mineral material and the water from the bitumen froth.

Froth treatment tailings therefore typically contain solid mineral material, water, froth treatment diluent, and small amounts of residual tailings bitumen (perhaps about 2 to 12 percent of the bitumen which was contained in the original bitumen froth).

Much of the froth treatment diluent is typically recovered from the froth treatment tailings in a tailings solvent recovery unit (TSRU). The froth treatment tailings (including the tailings bitumen) are then typically disposed of in a tailings pond.

Processing of Bitumen Froth Treatment Tailings to Recover Residual Bitumen

A significant amount of bitumen from the original oil sand ore is typically lost to the froth treatment tailings as tailings bitumen. There are both environmental incentives and economic incentives for recovering all or a portion of this tailings bitumen. The prior art includes attempts to recover bitumen from bitumen froth treatment tailings.

Canadian Patent No. 1,081,642 (Porteous) describes a method for treating froth treatment tailings obtained directly from a dilution centrifuging circuit which comprises introducing the tailings into a flotation cell, subjecting the tailings to agitation and flotation using gas introduced into the base of the body of tailings in order to recover bitumen and diluent as froth and in order to reject a portion of the solids and water as underflow, and removing the froth from further treatment.

Canadian Patent No. 1,094,484 (Lane et al.) describes a method similar to the method in Porteous, with the added steps of mixing the froth with a further portion of hydrocarbon diluent, treating the diluted froth in a scroll-type centrifugal separator to reject solids, water and a minor part of the hydrocarbons as tailings and produce a first product stream comprising hydrocarbons, water and a minor part of the solids, and treating the first product stream in a disc-type centrifugal separator to reject water, solids and a minor part of the hydrocarbons as tailings and produce a second product stream comprising hydrocarbons and a minor part of the water and solids.

Canadian Patent No. 1,238,597 (Seitzer) describes a process for the recovery of diluent and bitumen from the predominantly aqueous phase separated from an electrostatic treater used to separate bitumen from tar sands tailings to which a diluent such as naphtha has been added by adding a clay deflocculant to such diluted tailings, allowing separation to a top organic layer and a bottom aqueous layer essentially free of organic material, and separating the layers to recover the organic diluent and the bitumen.

Canadian Patent No. 1,252,409 (St. Amour et al.) describes a method for recovering bitumen from a waste sludge obtained from a retention pond used to store tailings from water extraction of bitumen from tar sands. The tailings comprising the waste sludge are collected from various processing steps of the "hot water" process for primary extraction of bitumen from tar sands. The method includes the steps of conditioning the sludge by removing carbon dioxide and methane and thereafter reducing the viscosity of the sludge, subjecting the conditioned sludge to air flotation in an induced air type of flotation cell in order to obtain a froth, subjecting the froth to a froth settler wherein the mineral tailings are drained off and delivered to a cleaner cell for further processing, diluting the froth from the froth settler with water, deaerating the diluted froth, and separating a bitumen product from the froth. Separating the bitumen product from the froth includes diluting the deaerated froth with hot naphtha and heating the froth, feeding the diluted and heated froth to a hydrocyclone, feeding the overflow from the hydrocyclone to a centrifuge, and recovering the overflow from the centrifuge as the bitumen product.

Canadian Patent No. 2,662,346 (Moran et al.) and corresponding U.S. Pat. No. 8,382,976 (Moran et al.) describe a method for recovering tailings bitumen from froth treatment tailings. The method includes separating a froth treatment tailings and a fine mineral material fraction, providing the fine mineral material fraction as a first feed material, conditioning the first feed material in order to produce a conditioned first feed material, providing a second feed material which is derived from the conditioned first feed material, and subjecting the second feed material to solvent extraction in order to produce an extract containing an amount of the tailings bitumen. The method may further include dewatering the conditioned first feed material in order to produce the second feed material, and clarifying the extract to produce a clarified extract containing an amount of the tailings bitumen.

Processing of Bitumen Froth to Recover Heavy Minerals

The prior art includes attempts to recover heavy minerals from bitumen froth.

Canadian Patent No. 861,580 (Bowman) describes a process for the recovery of heavy metals from a primary bitumen froth. The process includes introducing a fluid slurry of bituminous sand containing heavy metal into a body of water, whereby a froth containing bitumen and increased concentrations of heavy metal rises to the top of said body of water and sand settles to the bottom thereof, and recovering heavy metal from said froth.

Canadian Patent No. 879,996 (Bowman) describes a process for the recovery of heavy metals from a secondary bitumen froth. The process includes introducing a fluid slurry of bituminous sand containing heavy metal into a body of water whereby bituminous froth is floated to the top of such body of water and recovered therefrom while sand is allowed to settle to the bottom of such body of water for removal therefrom, withdrawing water containing fines and bitumen from an intermediate portion of such body of water and passing same to a second body of water wherein additional bituminous froth is floated to the top and recovered therefrom, and recovering heavy metal from such additional both.

Canadian Patent No. 927,983 (Fences) describes a process for the recovery of heavy metal materials from primary bitumen froth. The process includes introducing a fluid slurry of bituminous sand into a body of water whereby a froth containing bitumen and solids floats to the top of the water and is recovered therefrom. Solids are recovered from this froth and the recovered solids are treated with sodium hydroxide and then subjected to a flotation treatment using aeration gas. During the flotation treatment, solids other than heavy metal are selectively floated and heavy metals, especially zircon, remain in the bottom of the flotation zone from which they may be recovered.

Processing of Bitumen Froth Treatment Tailings to Recover Heavy Minerals

The solid mineral material which is included in the froth treatment tailings comprises an amount of heavy minerals. Heavy minerals are typically considered to be solid mineral material which has a specific gravity greater than that of quartz (i.e., a specific gravity greater than about 2.65). The heavy minerals in the solid mineral material which is contained in typical froth treatment tailings may include titanium metal minerals such as rutile ($TiO_2$), anatase ($TiO_2$), ilmenite ($FeTiO_3$) and leucoxene (typically an alteration product of ilmenite) and zirconium metal minerals such as zircon ($ZrSiO_4$). Titanium and zirconium bearing minerals are typically used as feedstocks for manufacturing engineered materials due to their inherent properties.

Although oil sand ore may contain a relatively low concentration of heavy minerals, it is known that these heavy minerals tend to concentrate in the bitumen froth which is extracted from the oil sand ore, and therefore become concentrated in the froth treatment tailings which result from froth treatment processes, primarily as coarse mineral material. As a result, froth treatment tailings may typically contain a sufficient concentration of heavy minerals to provide an environmental and economic incentive to recover these heavy minerals fern the froth treatment tailings. The prior art includes attempts to recover heavy minerals from bitumen froth treatment tailings.

Canadian Patent No. 1,013,696 (Baillie et al.) describes a process for producing from froth treatment tailings a quantity of heavy metal compounds such as titanium and zirconium minerals which are substantially free of bitumen and other hydrocarbon substances. The process includes separating bitumen froth together with solid components including heavy minerals from the sand in a main separation zone; separating the bitumen froth from the solid components, thereby forming a mineral waste product stream containing solid components including heavy minerals selected from the group consisting of titanium and zirconium and minerals, and combinations thereof; adding to the mineral waste product stream a liquid hydrocarbon solvent boiling in the range of 100 to 600 degrees Fahrenheit and containing at least 10 volume percentage aromatic hydrocarbons; separating the minerals from the solvent-mineral waste product mixture; and washing the minerals to remove the remaining solvent, thereby producing a quantity of heavy metal compounds substantially free of bitumen and other hydrocarbon substances.

Canadian Patent No. 1,076,504 (Kaminsky et al.) describes a process for concentrating and recovering titanium and zirconium containing minerals from froth treatment tailings. An oily mass of solids tailings containing a high concentration of heavy minerals, in the order of 10% by weight titanium and 4% zirconium, is derived from flotation of bitumen during hot water extraction of bituminous sands, and subsequent separation of most of the bitumen from associated solids. The tailings are introduced into a hot reaction zone and contacted with oxygen while agitating the solids. The bitumen associated with the solids is burned, as is residual coke left from the combustion of the bitumen. The product particles are discrete, dry and clean. They can be slurried with water and passed through gravity concentrating means, such as a spiral, to produce a concentrate containing in the order of 18% titanium and 8% zirconium.

Canadian Patent No. 1,088,883 (Trevoy et al.) describes a dry separatory process for concentrating titanium-based and zirconium-based minerals from first stage centrifuge froth treatment tailings. The titanium and zirconium-based minerals, present in the first stage centrifuge tailings from the hot water process for extraction of bitumen from bituminous sands, may be concentrated by a dry screening process. The tailings are burned off to provide a dry, essentially carbon-free, mineral mixture. By screening the mixture into three streams of different particle size range, silica and clays may be rejected as coarse and fine materials respectively, while titanium and zirconium minerals may be concentrated in the intermediate stream. The titanium and zirconium concentrate stream may be advanced to high tension and magnetic separation steps known in conventional processing of heavy minerals, for further beneficiation.

Canadian Patent No. 1,326,571 (Ityokumbul et al.) describes a process for recovering metals such as titanium and zirconium from froth treatment tailings. The process comprises ensuring that the pH of the a tailings slurry is in the range of from about 8 to about 11.5, subjecting the slurry to a flotation step in a flotation vessel comprising injecting air to cause flotation of a substantial amount of said metals in a froth above the siliceous and other unwanted material, and removing the floating froth containing the substantial amount of metals from the remainder of the slurry.

Canadian Patent No. 2,426,113 (Reeves et al.) describes a process for recovering heavy minerals from froth treatment tailings. The process includes contacting a tar sands-derived solids fraction with water at a temperature of at least about 100 degrees Fahrenheit to cause production a bituminous phase and a heavy minerals phase; and separating the heavy minerals phase from the bituminous phase.

Canadian Patent Application No. 2,548,006 (Erasmus et al.) and corresponding U.S. Patent Application Publication No. U.S. 2007/0272596 A1 (Erasmus et al.) describe a process for recovering heavy minerals from oil sand tailings (i.e., froth treatment tailings) in which the tailings are first "deslimed" in a designing means in order to remove a portion of the free fines and residual bitumen therefrom. The desliming means is comprised of one or more enhanced gravity separators, such as hydrocyclones or centrifuges. The deslimed oil sand tailings are then processed by being sequentially attritioned in an attritioner and separated in a separation means to separate the heavy minerals from other coarse solids present in the deslimed oil sand tailings and produce a concentrated heavy minerals fraction. The attritioner may be a Denver Cell™ type attritioner. The separation means may be comprised of a wide variety of separation apparatus and/or of combinations of such separation apparatus. The concentrated heavy minerals fraction may be further processed to remove residual bitumen therefrom and thereby produce a washed concentrated heavy minerals fraction. No processing is described for the slimes which are removed by the desliming means.

Canadian Patent No. 2,693,879 (Moran et al.) and corresponding U.S. Pat. No. 8,852,429 (Moran et al.) describe a method for processing froth treatment tailings. The method includes separating the froth treatment tailings in order to produce a coarse mineral material fraction and a fine mineral material fraction therefrom, subjecting the coarse mineral material fraction to froth flotation in order to produce a heavy mineral concentrate and a coarse mineral material tailings therefrom, and subjecting the heavy mineral concentrate to solvent extraction in order to produce a debitumenized heavy mineral concentrate and a bitumen extract therefrom.

In light of the large industrial scale of processes for oil sands ore processing, even incremental improvements in process parameters may have a substantial practical effect on the economics and environmental impacts of oil sands ore processing. Such environmental impacts may include demand on water resources, emissions of volatile organic compounds, emissions of greenhouse gases, and contamination of water supplies with bitumen, heavy minerals, and diluent. Therefore, notwithstanding the existence of methods to the prior art, there remains a need for methods for recovering bitumen, heavy minerals, and water from froth treatment tailings, and in particular from froth treatment tailings that are produced from paraffinic froth treatment processes and that comprise asphaltenes and non-asphaltenic material in the bitumen. Such methods are preferably are more effective in the recovery of bitumen, heavy minerals, and water, and more efficient in terms of the amount of diluent and make-up water consumed in the method.

SUMMARY OF THE INVENTION

Terminology—General

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

In this document, references to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise. All numbers and ranges disclosed above may vary by some amount. Whenever a numerical range with a lower limit and an upper limit is disclosed, any number and any included range falling within the range is specifically disclosed. In particular, every range of values disclosed herein is to be understood to set forth every number and range encompassed within the broader range of values.

Terminology—Separation Processes and Apparatuses

In this document, "solvent extraction" means an operation in which components of a mixture are separated by adding to the mixture a suitable liquid solvent which dissolves or dilutes one or more components of the mixture, thereby facilitating separation of components of the mixture.

In this document, "solvent extraction apparatus" includes gravity settlers (including without limitation, gravity settling vessels, inclined plate separators, and rotary disc contactors) and enhanced gravity separators (including without limitation, centrifuges and hydrocyclones).

In this document, "gravity settling" means an operation in which components of a mixture are separated using gravity, and is therefore distinguished from other separation operations such as molecular sieve processes, absorption processes, adsorption processes, magnetic processes, electrical processes, enhanced gravity settling processes, etc.

In this document, "gravity settler" includes a gravity settling vessel, an inclined plate separator, a rotary disc contactor, a thickener, and any other suitable apparatus which facilitates gravity settling, with or without the use of process aids such as flocculants and demulsifiers. In this document, gravity settler also includes a mixing apparatus which may be used in association with the gravity settling operation.

In this document, "gravity settling vessel" means a tank or other vessel into which a mixture may be introduced in order to facilitate separation of the mixture using gravity, but is distinguishable from an inclined plate separator. A gravity settling vessel may have any shape, size and/or configuration which are suitable for achieving gravity separation. A gravity settling vessel may or may not include internal structures such as weirs, sumps, launders, baffles, distributors, etc. and may or may not include internal mechanical devices such as rakes, conveyors, angers, etc.

In this document, "inclined plate separator" means an apparatus which is comprised of a plurality of stacked inclined plates onto which a mixture to be separated may be introduced so that the mixture passes along the plates in order to achieve separation of components of the mixture, and is distinguishable from a gravity settling vessel.

In this document, "enhanced gravity separation" means an operation in which components of a mixture are separated using centrifugal acceleration or centripetal acceleration resulting from rotational movement of the mixture, and is therefore distinguished from gravity separation processes.

In this document, "enhanced gravity separator" or "enhanced gravity separation apparatus" includes a centrifuge, a hydrocyclone and any other suitable apparatus which facilitates enhanced gravity separation.

Terminology—Diluent

In this document, "diluent" may include a froth treatment diluent and/or a hydrocarbon diluent.

In this document, "froth treatment diluent" means any substance containing one or more hydrocarbon compounds and/or substituted hydrocarbon compounds which is suitable for use in diluting bitumen froth in a froth treatment process.

In this document, "hydrocarbon diluent" means any substance containing one or more hydrocarbon compounds and/or substituted hydrocarbon compounds which is suitable for use for diluting bitumen in the practice of the invention.

In this document, "naphthenic type diluent" means a froth treatment diluent or a hydrocarbon diluent which includes a sufficient amount of one or more aromatic compounds so that the diluent essentially exhibits the properties of a naphthenic type diluent as recognized in the art, as distinguished from a paraffinic type diluent. In this document, a naphthenic type diluent may therefore be composed of a mixture of aromatic and non-aromatic compounds, including but not limited to such substances as naphtha (i.e., commercial naphtha) and toluene.

In this document, "paraffinic type diluent" means a froth treatment diluent or a hydrocarbon diluent which includes a sufficient amount of one or more relatively short-chain aliphatic compounds (such as, for example, C5 to C8 aliphatic compounds) so that the diluent essentially exhibits the properties of a paraffinic type diluent as recognized in the art, as distinguished from a naphthenic type diluent. In this document, a paraffinic type diluent may therefore be comprised of a mixture of aliphatic and non-aliphatic compounds, including but not limited to such substances as natural gas condensate.

Terminology—Froth Treatment Processes

In this document, "naphthenic froth treatment process" means a froth treatment process which uses a sufficient amount of one or more naphthenic type diluents so that the froth treatment process is recognized in the art as a naphthenic froth treatment process as distinguished from a paraffinic froth treatment process.

In this document, "paraffinic froth treatment process" means a froth treatment process which uses a sufficient amount of one or more paraffinic type diluents so that the froth treatment process is recognized in the art as a paraffinic froth treatment process as distinguished from a naphthenic froth treatment process.

In this document, "froth flotation" means an operation in which components of a mixture are separated by passing a gas through the mixture so that the gas causes one or more components of the mixture to float to the top of the mixture and form a froth. In this document, froth flotation may be performed using flotation cells or tanks, flotation columns or any other suitable froth notation apparatus, which may or may not include agitators or mixers, and froth flotation may include the use of flotation aids, including without limitation, surfactants and frothing agents.

Terminology—Solid Mineral Material

In this document, "solid mineral material" may comprise one or a combination of sands rock, silt, or clay.

In this document, "coarse solid mineral material" refers to solid mineral material having a particle size equal to or greater than about 44 microns. In some embodiments, coarse solid mineral material may comprise sand and rock.

In this document, "fine solid mineral material" comprises solid mineral material having a particle size less than about 44 microns. In some embodiments, fine solid mineral material may comprise silt and clay.

The Invention

In one aspect, the present invention comprises a method for processing froth treatment tailings separated from a bitumen froth produced in a process for recovering bitumen from oil sand ore. The froth treatment tailings comprise a solid mineral material, bitumen, and water. The solid mineral material comprises a coarse solid mineral material and a line solid mineral material. The method may be used to recover one or more extracts comprising at least a portion of the bitumen from the froth treatment tailings, and a debitumenized heavy mineral concentrate. In embodiments, the method may be further used to recover one or a combination of a froth treatment diluent and a hydrocarbon diluent. In embodiments, the method may be further used to recover water from the froth treatment tailings or water added during the method.

In an exemplary aspect, the method of the present invention comprises the steps of:

(a) subjecting the froth treatment tailings to a first solvent extraction process to produce a first extract, and a first raffinate; wherein the first extract comprises a first extract amount of the bitumen; and wherein the first raffinate comprises the solid mineral material, and a first raffinate amount of the bitumen;

(b) subjecting the first raffinate to a separation process to produce a fine mineral material fraction and a coarse mineral material fraction therefrom; wherein, the fine mineral material fraction comprises the fine solid mineral material; and wherein the coarse mineral material fraction comprises the coarse solid mineral material, and a coarse mineral material friction amount of the bitumen;

(c) subjecting the coarse solid mineral material fraction to a froth flotation process to produce a heavy mineral concentrate and a coarse mineral material tailings therefrom; wherein the heavy mineral concentrate comprises a heavy mineral concentrate amount of the coarse solid mineral material, a heavy mineral concentrate amount of the bitumen, and water; and (d) subjecting the heavy mineral concentrate to a second solvent extraction process to produce a second extract and a second raffinate; wherein the second extract comprises a second extract amount of the bitumen; and wherein the second raffinate comprises a debitumenized heavy mineral concentrate.

It is noted that the method comprises two solvent extraction processes in series, and that the froth treatment tailings are subjected to the first solvent extraction process before being subjected to the separation process, the froth flotation process and the second solvent extraction process. Accordingly, the froth treatment tailings are subjected to the first solvent extraction process when the froth treatment tailings comprise both the coarse solid mineral material and the fine solid mineral material. This ordering of steps in the process of the present invention may allow for more efficient processing of froth treatment tailings in comparison with processes that separate the froth treatment tailings into a stream comprising only coarse solid mineral material, and a stream comprising only a fine solid material, before subjecting the separated streams to further processing, such as disclosed in Canadian Patent No. 2,662,346 (Moran et al.) and Canadian Patent No. 2,693,879 (Moran et al.). Without restriction to a theory, it is believed that the potentially higher efficiency in recovering bitumen from the froth treatment tailings is attributable to the closer packing of particles in the mixture of coarse solid mineral material and the fine solid mineral material. The closer packing of the particles allows for a greater surface area of the particles to be exposed to particle-particle interactions and particle-solvent interactions, which in turn allows for more efficient recovery of the bitumen for a given solvent to feed material ratio (S/F) and mixing intensity during the first solvent extraction process. As a consequence, the process of the present invention may require less aggressive process conditions during the second solvent extraction process (e.g., lower solvent-to-feed material ratios, and a reduced number of stages of the second solvent extraction process) to produce the debitumenized heavy mineral concentrate.

Further, the method of the present invention may be suitable for processing of froth treatment tailings produced from a paraffinic froth treatment process, which may be characterized by bitumen having a high asphaltene content.

In some embodiments, the froth treatment tailings may contain little or no froth treatment diluent, either because the froth treatment diluent has been recovered, prior to the method of the present invention, from the froth treatment tailings in a tailings solvent recovery unit (TSRU) process or a similar process, or because the separation of the froth treatment tailings from the bitumen froth has not required the use of a froth treatment diluent. In some embodiments, the froth treatment tailings may comprise a froth treatment diluent used in diluting and/or dissolving bitumen froth in the froth treatment process. The froth treatment diluent may be one or a combination of a naphthenic type diluent or a paraffinic type diluent.

In embodiments the first solvent extraction process comprises adding a hydrocarbon diluent to the froth treatment tailings. In embodiments, the ratio by weight of hydrocarbon diluent to the froth treatment tailings may be as low as 0.3, and may be in a range of about 0.3 to about 0.5 embodiments where the bitumen in the froth treatment tailings comprises an asphaltene enriched bitumen component and a maltene component, the method may further comprise selecting a relative proportion of a naphthenic type diluent to a paraffinic type diluent in the hydrocarbon diluent to selectively vary the relative proportion of the asphaltene enriched bitumen component to the maltene component in the first extract amount of the bitumen.

In embodiments, the method further comprises subjecting an intermediate product to a diluent recovery process to produce a recovered diluent and a diluent recovered intermediate product. In embodiments, the intermediate product may comprise one or a combination of the fine mineral material fraction, the coarse mineral material tailings, and the debitumenized heavy mineral concentrate.

In embodiments wherein the intermediate product comprises one or a combination of the fine mineral material fraction and the coarse mineral material tailings, the method may further comprise recovering water from the diluent recovered intermediate product. In embodiments, recovering water from the diluent recovered intermediate product comprises adding a flocculant to the diluent recovered intermediate product to flocculate solids in the diluent recovered intermediate product to produce a mixture of diluent recovered intermediate product and flocculated solids, and subjecting the mixture of diluent recovered intermediate product and flocculated solids to a gravity settling or enhanced gravity separation process to produce a recovered water portion and a thickened slurry therefrom. In embodiments, the flocculant comprises may comprise a polymer. In embodiments, the thickened slurry may have a solids concentration of at least about 40 percent by weight. In embodiments, the thickened slurry may be suitable for direct depositing into tailing ponds and other depositional environments, to be subjected to thin-lift drying to produce trafficable deposits. In embodiments, the recovered water portion may be recycled to the process for recovering bitumen from oil sands.

First Solvent Extraction Process

A purpose of subjecting the froth treatment tailings to the first solvent extraction process is to produce a first extract comprising a first extract amount of the bitumen. Another purpose of subjecting the froth treatment tailings to the first solvent extraction process is to produce a first raffinate, which can be subjected to further processing to produce the heavy mineral concentrate.

First Solvent Extraction Process—Hydrocarbon Diluent

Subjecting the froth treatment tailings to the first solvent extraction process may be comprised of adding an amount of a hydrocarbon diluent to the froth treatment tailings. The hydrocarbon diluent may be comprised of or consist of any suitable naphthenic type diluent or any suitable paraffinic type diluent.

In embodiments in which the hydrocarbon diluent is comprised of a paraffinic type diluent, the amount of the paraffinic type diluent may be selected so that the precipitation of asphaltenes from the froth treatment tailings is minimized and so that the recovery of bitumen from the froth treatment tailings is maximized.

In some particular embodiments in which the hydrocarbon diluent is comprised of a naphthenic type diluent, the hydrocarbon diluent may be comprised of or consist of naphtha or toluene. In some particular embodiments in which the hydrocarbon diluent is comprised of or consists of naphtha, the naphtha may have an aromaticity of between about 10 and 20 percent.

The performance of the hydrocarbon diluent in the first solvent extraction process may be dependent upon the solvent to froth treatment tailings ratio by weight, upon the solvent to bitumen ratio by weight, upon the temperature at which the first solvent extraction process is performed, and upon the length of time for which the first solvent extraction process is performed.

In embodiments in which the hydrocarbon diluent consists essentially of naphtha, the extent of recovery of bitumen from the froth treatment tailings in the first solvent extraction process may be maximized if the hydrocarbon diluent to froth treatment tailings ratio by weight is relatively low (i.e., in the range of about 0.3 to about 0.5).

In embodiments in which the froth treatment tailings is comprised of an amount of a froth treatment diluent, the hydrocarbon diluent may be selected having regard to the composition of the froth treatment diluent. As a first consideration, in some applications it may be convenient for the composition of the froth treatment diluent and the composition of the hydrocarbon diluent to be similar so that a single type of diluent can be provided for both froth treatment and for the practice of the invention.

However, as a second consideration, the use of a paraffinic type diluent as the hydrocarbon diluent where the froth treatment tailings is comprised of an amount of a paraffinic type diluent as the froth treatment diluent may not be effective to recover precipitated asphaltenes from the froth treatment tailings, unless the concentration of the hydrocarbon diluent during solvent extraction can be maintained below the critical level which results in significant asphaltene precipitation. Stated otherwise, the use of a paraffinic type diluent as the hydrocarbon diluent may be reasonably effective for recovering non-asphaltenic bitumen material from the froth treatment tailings, but may be less effective for recovering asphaltenes from the froth treatment tailings.

As a result, where the froth treatment tailings is comprised of an amount of a naphtha type diluent as the froth treatment diluent, tire hydrocarbon diluent may also be comprised of a naphtha type diluent, since asphaltene precipitation is not a major concern. Where the froth treatment tailings is comprised of an amount of a naphtha type diluent as the froth treatment diluent, the hydrocarbon diluent may be comprised of a paraffinic type diluent if recovery of asphaltenes from the froth treatment tailings is not essential or if the concentration of the paraffinic type diluent can be maintained below the critical level which results in significant asphaltene precipitation.

Where the froth treatment tailings is comprised of an amount of a paraffinic type diluent as the froth treatment diluent, the hydrocarbon diluent may be comprised of a naphtha type diluent, since the naphtha type diluent may facilitate the recovery of asphaltenes from the froth treatment tailings. Where the froth treatment tailings is comprised of an amount of a paraffinic type diluent, the hydrocarbon diluent may be comprised of a paraffinic type diluent if recovery of asphaltenes from the froth treatment tailings is not essential of if the concentration of the paraffinic type diluent can be maintained below the critical level which results in significant asphaltene precipitation.

First Solvent Extraction Process—Stages and Apparatuses

Subjecting the froth treatment tailings to the first solvent extraction process may be further comprised of passing the froth treatment tailings through one or more stages of a first solvent extraction process apparatus. The stages of the first solvent extraction process apparatus may be comprised of any suitable solvent extraction apparatus or combination of solvent extraction apparatus. A plurality of stages of a first solvent extraction process apparatus may be arranged in any suitable configuration, including without limitation, a co-current configuration or a countercurrent configuration.

In some particular embodiments, subjecting the froth treatment tailings to the first solvent extraction process may be further comprised of subjecting the froth treatment material to gravity settling. In some particular embodiments, subjecting the froth treatment tailings to the first solvent extraction process may be further comprised of passing the froth treatment material through a plurality of stages of gravity settlers arranged in a countercurrent configuration. In some particular embodiments, the number of stages of gravity settlers may be two. In some particular embodiments, the number of stages of gravity settlers may be three or more. In some particular embodiments, the gravity settlers may be comprised of gravity settling vessels, inclined plate separators, rotary disc contactors, and combinations thereof.

The amount of hydrocarbon diluent which is added to the froth treatment tailings may be selected to provide a desired solvent to froth treatment tailings ratio by weight in the froth treatment tailings. Alternatively, the amount of hydrocarbon diluent which is added to the froth treatment tailings may be selected to provide a desired solvent to bitumen ratio by weight in the froth treatment tailings.

In some particular embodiments, the desired solvent to froth treatment tailings ratio by weight and/or the desired solvent to bitumen ratio by weight may be increased as the froth treatment tailings is passed through each stage of the first solvent extraction process apparatus.

In embodiments in which the froth treatment tailings is comprised of an amount of a froth treatment diluent, the solvent to froth treatment tailings ratio may be determined having regard to both the composition and the amount of the froth treatment diluent which is included in the froth treatment tailings.

In some embodiments in which the hydrocarbon diluent and the froth treatment diluent consist essentially of a naphthenic type diluent, the froth treatment tailings may be subjected to a first solvent extraction stage of the first solvent extraction process in which a solvent to bitumen ratio by weight is generally between about 1 and about 10, and the froth treatment tailings may be subjected to a second solvent extraction stage of the first solvent extraction process in which the solvent to froth treatment tailings ratio by weight is generally between about 5 and about 100.

In some embodiments in which the hydrocarbon diluent and the froth treatment diluent consist essentially of a naphthenic type diluent, the froth treatment tailings may be subjected to a first solvent extraction stage of the first solvent extraction process in which a solvent to froth treatment tailings ratio by weight is generally between about 0.09 and about 1, and the froth treatment tailings may be subjected to a second solvent extraction stage of the first solvent extraction process in which the solvent to froth treatment tailings ratio by weight is generally between about 0.1 and about 1.

In some embodiments in which the hydrocarbon diluent and the froth treatment diluent consist essentially of naphtha as a naphthenic type diluent, the froth treatment tailings may be subjected to a first solvent extraction stage of the first solvent extraction process in which the solvent to froth treatment tailings ratio by weight is between about 0.09 and about 0.75, between about 0.09 and about 0.5, or between about 0.09 and about 0.25.

In some embodiments in which the hydrocarbon diluent and the froth treatment diluent consist essentially of naphtha as a naphthenic type diluent, the froth treatment tailings may be subjected to a second solvent extraction stage of the first solvent extraction process in which the solvent to froth treatment tailings ratio by weight is between about 0.1 and about 1, between about 0.1 and about 0.5, or between about 0.1 and about 0.3.

In some embodiments in which the hydrocarbon diluent and the froth treatment diluent consist essentially of a paraffinic type diluent, the froth treatment tailings may be subjected to solvent extraction under conditions in which the solvent to feed material ratio by weight may be less than a solvent to froth treatment tailings ratio which will result in significant asphaltene precipitation.

First Solvent Extraction Process—Intra-Stage Recycling

In some embodiments, any solvent extraction stage or stages of the first solvent extraction process may further comprise producing an intermediate component produced between an overflow zone and an underflow zone of a gravity settlor and recycling the intermediate component to the solvent extraction stage so that the feed material for the solvent extraction stage is further comprised of the recycled amount of the intermediate component. In embodiments, the ratio by weight of the recycled amount of the intermediate component to the feed material for the solvent extraction stage is in a range of between about 0.1 to about 0.9, and more particularly in the range between about 0.25 to about 0.5.

First Solvent Extraction Process—Inter-Stage Differential Underflow Withdrawal Rate In some embodiments where the first solvent extraction process comprises passing the froth treatment tailings through a plurality of solvent extraction stages of a plurality of extraction apparatus each producing an underflow component and an overflow component, the first solvent extraction process may be further comprised of withdrawing the underflow component from m earlier solvent stage at a greater rate than withdrawing the underflow component from a later solvent stage. In embodiments, the ratio of the withdrawal rate by weight of the underflow component from the later solvent stage to the withdrawal rate of the underflow component from the earlier solvent stage is in the range of between about 0 to about 1, and more particularly in the range between about 0.05 to about 0.5.

Separation Process

A purpose of subjecting the first raffinate to the separation process is to provide a conditioned feed material for the froth flotation process. More particularly, separating the first raffinate to produce a coarse mineral material fraction and a fine mineral material fraction therefrom results in amounts of slimes (i.e., fine mineral material) and bee bitumen reporting to the fine mineral material fraction so that they are diverted from the coarse mineral material fiction. These slimes and free bitumen can decrease the flotation response of the heavy minerals, destabilize the froth, and result in poor flotation recovery of the heavy minerals. Separating the froth treatment tailings to produce the coarse mineral material fraction and the fine mineral material fraction may therefore be referred to as "desliming" the froth treatment tailings.

Separating the first raffinate to produce the coarse mineral material fraction and the fine mineral material fraction may be performed in any manner. As non-limiting examples, the first raffinate may be separated to produce the coarse mineral material fraction and the fine mineral material fraction by gravity settling and/or by enhanced gravity separation.

In some embodiments, the first raffinate may be separated to produce the coarse mineral material fraction and the fine mineral material fraction by enhanced gravity separation. In some embodiments, separating the first raffinate to produce the coarse mineral material fraction and the fine mineral material fraction may be comprised of passing the first raffinate through an enhanced gravity separation apparatus. In some embodiments, the enhanced gravity separation apparatus may be comprised of a hydrocyclone.

Froth Flotation Process

A purpose of subjecting the coarse mineral material fraction to a froth flotation process is to concentrate the heavy minerals contained in the coarse mineral material fraction, thereby producing a heavy mineral concentrate and a coarse mineral material tailings therefrom. Concentrating the heavy minerals in the heavy mineral concentrate reduces the amount of feed material which must subsequently be processed in order to recover the heavy minerals. Subjecting the coarse mineral material fraction to the froth flotation process may be performed in any manner which is effective to produce the heavy mineral concentrate and the coarse mineral material tailing therefrom.

Froth Flotation Process—Heavy Mineral Proportions

The froth flotation process is performed so that the heavy mineral concentrate is comprised of a high proportion of the heavy minerals that are contained in the coarse mineral material fraction (particularly the titanium metal minerals and the zirconium metal minerals contained therein), and is performed so that the coarse mineral material tailings are comprised of a low proportion of the heavy minerals that are contained in the coarse mineral material fraction. The coarse mineral material tailings may typically be comprised of a high proportion of quartz and other solid mineral material, that are not considered to be heavy minerals.

Froth Flotation Process—Bitumen Proportions

In some embodiments, the froth flotation process is also performed so that the heavy mineral concentrate is comprised of a high proportion of the bitumen which is contained in the coarse mineral material fraction, and is performed so that the coarse mineral material tailings are comprised of a low proportion of the bitumen which is contained in the coarse mineral material fraction.

Froth Flotation Process—Frothing Agent

The froth flotation process may be comprised of adding an amount of a frothing agent to the coarse mineral material fraction and passing a gas such as air through the coarse mineral material fraction. The frothing agent may be comprised of any suitable substance or combination of substances. In some embodiments, the frothing agent may be comprised of or may consist essentially of a glycol based frother. In some embodiments, the frothing agent may be comprised of or may consist essentially of an alcohol based frother. In some embodiments, a suitable glycol based frother may be Cytec™ F-507 frother, a product of Cytec Industries Inc.

The concentration of the frothing agent in the coarse mineral material fraction that is being subjected to the froth flotation may be any concentration which is suitable for encouraging the formation of a froth layer. In some embodiments, the concentration of the frothing agent in the food material may be less than or equal to about 200 grams of frothing agent per tonne of solid mineral material which is included in the coarse mineral material fraction. In some embodiments, the concentration of the frothing agent in the feed material may be less than or equal to about 100 grams per tonne of solid mineral material which is included in the coarse mineral material fraction. In some embodiments, the concentration of the frothing agent in the feed material may be between about 15 grams and about 50 grams per tonne of solid mineral material which is included in the coarse mineral material fraction.

In some embodiments, the suitable concentration of the frothing agent in the coarse mineral material fraction may be dependent upon the amount of bitumen which is contained in the coarse mineral material fraction. More particularly, higher amounts of bitumen in the coarse mineral material fraction may suggest higher suitable concentrations of the frothing agent in the coarse mineral material fraction.

Froth Flotation Process—Solid Mineral Material Concentration

The coarse mineral material fraction has a solid mineral material concentration. The coarse mineral material fraction may have any solid mineral material concentration that is suitable for conducting the froth flotation process. In some embodiments, the coarse mineral material fraction may have a solid mineral material concentration of at least about 20 percent by weight of the coarse mineral material fraction when the coarse mineral material fraction is introduced to the froth notation process. In some embodiments, the coarse mineral material fraction may have a solid mineral material concentration of between about 20 percent and about 80 percent by weight of the coarse mineral material fraction when the coarse mineral material fraction is introduced to the froth flotation process.

Froth Flotation Process—Stages and Apparatuses

In some embodiments, subjecting the coarse mineral material fraction to the froth flotation process is comprised of producing the heavy mineral concentrate as a froth flotation float product and producing the coarse mineral material tailings as a froth flotation sink product.

The froth flotation process may be comprised of a single stage of froth flotation or the froth flotation may be comprised of a plurality of stages of froth flotation.

In some embodiments, the froth flotation process may be performed in a flotation apparatus which may be comprised of one or more flotation vessels. In some embodiments, the flotation apparatus may be comprised of a plurality of flotation vessels which may be arranged in a parallel configuration and/or in a series configuration.

In some embodiments, the froth flotation process may be comprised of a roughest froth flotation stage and a scavenger froth flotation stage. In some embodiments, subjecting the coarse mineral material fraction to froth flotation may be comprised of subjecting the coarse mineral material fraction to the rougher froth flotation stage in order to produce a rougher stage float product and a rougher stage sink product, and may be further comprised of subjecting the rougher stage sink product to the scavenger froth flotation stage in order to produce a scavenger stage float product and a scavenger stage sink product.

In some embodiments, the heavy mineral concentrate may be comprised of the rougher stage float product and the scavenger stage float product, and the method may be further comprised of combining the rougher stage float product and the scavenger stage float product to provide the heavy mineral concentrate. In some embodiments, the heavy mineral concentrate may consist essentially of the rougher stage float product and the scavenger stage float product. In some embodiments, the coarse mineral material tailings may be comprised of or may consist essentially of the scavenger stage sink product.

In some embodiments, subjecting the rougher stage sink product to the scavenger froth flotation stage may be comprised of adding an amount of a collector to the rougher stage sink product to enhance the recovery of heavy minerals from the rougher stage sink product in the scavenger froth notation stage. The collector may be comprised of any suitable substance or combination of substances. In some embodiments, the collector may be comprised of a relatively low molecular weight hydrocarbon compound or a combination of relatively low molecular weight hydrocarbon compounds. In some embodiments, the collector may be comprised of a hydrocarbon liquid. In some embodiments the hydrocarbon liquid may be selected from the group of hydrocarbon liquids consisting of kerosene, naphtha, and combinations thereof.

The concentration of the collector in the rougher stage sink product may be any concentration winch is suitable for collecting the heavy minerals that are contained in the rougher stage sink product without interfering significantly with the production of the froth layer in the scavenger froth flotation stage. In some embodiments, the concentration of the collector in the rougher stage sink product may be less than or equal to about 10 liters per tonne of solid mineral material which is included in the rougher stage sink product. In some embodiments, the concentration of the collector in the rougher stage sink product may be less than or equal to about 1 liter per tonne of solid mineral material which is included in the rougher stage sink product.

In some embodiments, the froth flotation process may be comprised of a rougher froth flotation stage and a cleaner froth flotation stage. In some embodiments, subjecting the coarse mineral material fraction to froth flotation may be comprised of subjecting the coarse mineral material fraction to the rougher froth flotation stage in order to produce a rougher stage float product and a rougher stage sink product, and may be further comprised of subjecting the rougher stage float product to the cleaner froth flotation stage in order to produce a cleaner stage float product and a cleaner stage sink product.

In some embodiments, the heavy mineral concentrate be comprised of the cleaner stage float product. In some embodiments, the heavy mineral concentrate may consist essentially of the cleaner stage float product. In some embodiments, the coarse mineral material tailings may be comprised of or may consist essentially of the rougher stage sink product and the cleaner stage sink product.

Second Solvent Extraction Process

A purpose of subjecting the heavy mineral concentrate to the second solvent extraction process is to reduce the amount of bitumen that is contained in the heavy mineral concentrate, thereby producing the debitumenized heavy mineral concentrate and a second extract comprising a second extract amount of the bitumen. Without the second solvent extraction process, the presence of more than a minimal amount of bitumen in the heavy mineral concentrate may interfere with subsequent processing to recover the heavy minerals from the heavy mineral concentrate.

Subjecting the heavy mineral concentrate to the second solvent extraction, process may be performed in any manner which is effective to produce the debitumenized heavy mineral concentrate and the bitumen extract. The debitumenized heavy mineral concentrate contains less bitumen than the heavy mineral concentrate and is therefore "debitumenized" relative to the heavy mineral concentrate.

The second solvent extraction process is comprised of separating the heavy mineral concentrate in order to produce the debitumenized heavy mineral concentrate and the second extract.

Second Solvent Extraction Process—Hydrocarbon Diluent

The second solvent extraction process may be performed using a diluent as a solvent. The diluent may be comprised of a hydrocarbon diluent which is introduced to the solvent extraction process and/or the diluent may be comprised of residual froth treatment diluent which is contained in the froth treatment tailings as a result of the froth treatment process.

The diluent may be comprised, of or may consist essentially of one or more suitable naphthenic type diluents or may be comprised of a mixture of one or more suitable naphthenic type diluents and/or paraffinic type diluents. The amount of the diluent may be any amount which is effective to facilitate the separation of the heavy mineral concentrate in order to produce the debitumenized heavy mineral concentrate and the second extract.

In some embodiments in which the diluent may be comprised of a paraffinic type diluent, the paraffinic type diluent may be present in the diluent as a residual amount of a froth treatment diluent that was contained in the froth treatment tailings as a result of a paraffinic froth treatment process. In some embodiments in which the diluent may consist essentially of one or more naphthenic type diluents, some of the naphthenic type diluent may be present in the diluent as a residual amount of a froth treatment diluent that was contained in the froth treatment tailings as a result of a naphthenic froth treatment process.

In some embodiments in which the diluent may be comprised of a paraffinic type diluent, the amount of the paraffinic type diluent may be selected in order to control the amount of asphaltenes which are precipitated during the second solvent extraction process, since precipitated asphaltenes will tend to be included in the debitumenized heavy mineral concentrate and not in the second extract. An excessive amount of precipitated asphaltenes contained in the debitumenized heavy mineral concentrate may interfere with subsequent processing to recover the heavy minerals from the debitumenized heavy mineral concentrate.

In some embodiments in which the diluent may be comprised of a naphthenic type diluent, a suitable diluent may be comprised of or may consist essentially of naphtha or toluene. In some embodiments, the diluent may be comprised of or may consist essentially of naphtha.

The amount of the diluent may be any amount which is suitable for conducting the second solvent extraction process. In some embodiments in which the diluent may be comprised of a naphthenic type diluent, the amount of the diluent may be selected in order to maximize the separation of the heavy mineral concentrate into the debitumenized heavy mineral concentrate and the second extract. In some embodiments in which the diluent may be comprised of a naphthenic type diluent, the amount of the diluent may be selected to be at least about 10 percent by weight of the feed material which is being subjected to the second solvent extraction process.

Second Solvent Extraction Process—Heavy Mineral Concentrate

The heavy mineral concentrate has a solid mineral material concentration. The heavy mineral concentrate may have any solid mineral material concentration that is suitable for conducting the second solvent extraction process. In some embodiments, the heavy mineral concentrate may have a solid mineral material concentration that is lower than a solid mineral material concentration that will interfere with the recovery of the bitumen e tract from the heavy mineral concentrate. In some embodiments, the heavy mineral concentrate may have a solid mineral material concentration of at least about 15 percent by weight of the heavy mineral concentrate when it is introduced to the second solvent extraction process. In some embodiments, the heavy mineral concentrate may have a solid mineral material concentration of less than or equal to about 80 percent by weight of the heavy mineral concentrate when it is introduced to the second solvent extraction process. In some embodiments, the heavy mineral concentrate may have a solid mineral material concentration of less than or equal to about 70 percent by weight of the heavy mineral concentrate when it is introduced to the second solvent extraction process. In some embodiments, the heavy mineral concentrate may have a solid mineral material concentration of between about 15 percent and 80 percent by weight of the heavy mineral concentrate when it is introduced to the second solvent extraction process.

Second Solvent Extraction Process—Attritioning

In some embodiments, the second solvent extraction process may be further comprised of attritioning the heavy mineral concentrate prior to separating the heavy mineral concentrate in order to enhance the separating of the heavy mineral concentrate by assisting in liberating the bitumen from the heavy mineral concentrate. Attritioning the heavy mineral concentrate in the process solvent extraction process may be performed in any manner which is effective to assist in liberating bitumen from the heavy mineral concentrate. In some embodiments, attritioning the heavy mineral concentrate may be comprised of mixing the heavy mineral concentrate in a mixing apparatus.

Second Solvent Extraction Process—Stages and Apparatuses

Separating the heavy mineral concentrate in the second solvent extraction process may be perforated in any manner that is effective to separate the heavy mineral concentrate to produce the debitumenized heavy mineral concentrate and the second extract. In some embodiments, the second solvent extraction process may be comprised of a single stage of solvent extraction or the second solvent extraction process may be comprised of a plurality of stages of solvent extraction. A plurality of stages of the second solvent extraction process may be comprised of a plurality of stages of separating. The plurality of stages of separating may be comprised of gravity settling, enhanced gravity separation, or a combination of gravity settling and enhanced gravity separation and may be comprised of passing the heavy mineral concentrate and/or a feed material derived therefrom through one or more gravity settlers, enhanced gravity separation apparatus, or a combination of gravity settlers and enhanced gravity separation apparatus.

A plurality of stages of the second solvent extraction process may be comprised of a single stage of attritioning or a plurality of stages of attritioning. In some embodiments, each stage in a plurality of stages of the second solvent extraction process may be comprised of attritioning a feed material for the solvent extraction stage and separating the attritioned feed material for the solvent extraction stage.

In some embodiments, the heavy mineral concentrate will become more "debitumenized" as the number of stages of the second solvent extraction process increases, so that the heavy mineral concentrate is progressively cleaned of bitumen by the stages of the second solvent extraction process. In such embodiments, the number of stages of the second solvent extraction process may be selected so that the bitumen concentration of the debitumenized heavy mineral concentrate is no greater than a desired limit which will facilitate subsequent processing of the debitumenized heavy mineral concentrate to recover the heavy minerals therefrom. In some embodiments, the desired limit of the bitumen concentration of the debitumenized heavy mineral concentrate may be about 0.5 percent, or about 0.05 percent, bitumen by weight of the debitumenized heavy mineral concentrate.

In some embodiments in which the second solvent extraction process may be comprised of a plurality of stages of solvent extraction, the stages of solvent extraction may be arranged in a co-current configuration or may be arranged in a countercurrent configuration.

In some embodiments, the second solvent extraction process may be comprised of a first solvent extraction stage. The first solvent extraction stage feed material may be comprised of the heavy mineral concentrate having a solid mineral material concentration. The first solvent extraction stage feed material may have any solid mineral material concentration that is suitable for conducting the first solvent extraction stage of the second solvent extraction process. In some embodiments, the first solvent extraction stage feed material may have a solid mineral material concentration that is lower than a solid mineral material concentration that will interfere with the separation of bitumen from the first solvent extraction stage feed material. In some embodiments, the first solvent extraction stage feed material may have a solid mineral material concentration of at least about 20 percent by weight of the first solvent extraction stage feed material. In some embodiments, the first solvent extraction stage feed material may have a solid mineral material concentration of less than or equal to about 80 percent by weight of the first solvent extraction stage feed material. In some embodiments, the first solvent extraction stage feed material may have a solid mineral material concentration of less than or equal to about 70 percent by weight of the first solvent extraction stage feed material. In some embodiments, the first solvent extraction stage feed material may have a solid mineral material concentration of between about 20 percent and 70 percent by weight of the first solvent extraction stage feed material.

The first solvent extraction stage feed material may include a first solvent extraction stage amount of a diluent. In some embodiments, the diluent may be comprised of or may consist essentially of a naphthenic type diluent such as naphtha and the first solvent extraction stage amount of the diluent may be at least about 10 percent by weight of the first solvent extraction stage feed material.

In some embodiments, the first solvent extraction stage may be comprised of attritioning a first solvent extraction stage feed material in order to produce an attritioned first solvent extraction stage feed material. In some embodiments, attritioning the first solvent extraction stage feed material in the first solvent extraction stage of the second solvent extraction process may be comprised of mixing the first solvent extraction stage feed material in a first solvent extraction stage mixing apparatus.

In some embodiments, the first solvent extraction stage may be further comprised of separating the attritioned first solvent extraction stage feed material in order to produce a first solvent extraction stage underflow component and a first solvent extraction stage overflow component. In some embodiments, separating the attritioned first solvent extraction stage feed material in the first solvent extraction stage of the second solvent extraction process may be comprised of passing the attritioned first solvent extraction stage feed material through a first gravity settler. In some embodiments, the first gravity settler may be comprised of a first gravity settling vessel.

In some embodiments, the second solvent extraction process may consist essentially of the first solvent extraction stage. In such embodiments, the debitumenized heavy mineral concentrate may be comprised of or may consist essentially of the first solvent extraction stage underflow component and the second extract may be comprised of or may consist essentially of the first solvent extraction stage overflow component.

In some embodiments, the second solvent extraction process may be further comprised of a second solvent extraction stage.

The second solvent extraction stage feed material may be comprised of the first solvent extraction stage underflow component. The second solvent extraction stage feed material has a solid mineral material concentration. The second solvent extraction stage feed material may have any solid mineral material concentration which is suitable for conducting the second solvent extraction stage. In some embodiments, the second solvent extraction stage feed material may have a solid mineral material concentration that is lower than a solid mineral material concentration that will interfere with the separation of bitumen from the second solvent extraction stage feed material. In some embodiments, the second solvent extraction stage feed material may have a solid mineral material concentration of at least about 20 percent by weight of the second solvent extraction stage feed material. In some embodiments, the second solvent extraction stage feed material may have a solid mineral material concentration of less than or equal to about 80 percent by weight of the second solvent extraction stage feed material. In some embodiments, the second solvent extraction stage feed material may have a solid mineral material concentration of less than or equal to about 70 percent by weight of the second solvent extraction stage feed material. In some embodiments, the second solvent extraction stage feed material may have a solid mineral material concentration of between about 20 percent and 70 percent by weight of the second solvent extraction stage feed material.

The second solvent extraction stage feed material may include a second solvent extraction stage amount of a diluent. In some embodiments, the diluent may be comprised of or may consist essentially of a naphthenic type diluent such as naphtha and the second solvent extraction stage amount of the diluent may be at least about 10 percent by weight of the second solvent extraction stage feed material.

In some embodiments, the second solvent extraction stage may be comprised of attritioning the second solvent extraction stage feed material in order to produce an attritioned second solvent extraction stage feed material. In some embodiments, attritioning the second solvent extraction stage feed material in the second solvent extraction stage may be comprised of mixing the second solvent extraction stage feed material in a second mixing apparatus.

In some embodiments, the second solvent extraction stage may be further comprised of separating the attritioned second solvent extraction stage feed material in order to produce a second solvent extraction stage underflow component and a second solvent extraction stage overflow component. In some embodiments, separating the attritioned second solvent extraction stage feed material in the second solvent extraction stage may be comprised of passing the attritioned second solvent extraction stage feed material through a second gravity settler. In some embodiments, the second gravity settler may be comprised of a second gravity settling vessel.

In some embodiments, the second solvent extraction process may consist essentially of the first solvent extraction stage and the second solvent extraction stage. In such embodiments, the debitumenized heavy mineral concentrate may be comprised of or may consist essentially of the second solvent extraction stage underflow component. In such embodiments, the second extract may be comprised of or may consist essentially of the first solvent extraction stage overflow component and/or the second solvent extraction stage overflow component.

In some embodiments, the first solvent extraction stage and the second solvent extraction stage may be arranged in a countercurrent configuration. In such embodiments, the second extract may be comprised of or may consist essentially of the first solvent extraction stage overflow component. In such embodiments, the first solvent extraction stage feed material may be further comprised of the second solvent extraction stage overflow component.

In some embodiments, the second solvent extraction process may be further comprised of a third solvent extraction stage. The third solvent extraction stage feed material may be comprised of the second solvent extraction stage underflow component. The third solvent extraction stage feed material has a solid mineral material concentration. The third solvent extraction stage feed material may have any solid mineral material concentration that is suitable for conducting the third solvent extraction stage. In some embodiments, the third solvent extraction stage feed material may have a solid mineral material concentration that is lower than a solid mineral material concentration which will interfere with the separation of bitumen from the third solvent extraction stage feed material. In some embodiments, the third solvent extraction stage feed material may have a solid mineral material concentration of at least about 20 percent by weight of the third solvent extraction stage feed material. In some embodiments, the third solvent extraction stage feed material may have a solid mineral material concentration of less than or equal to about 80 percent by weight of the third solvent extraction stage feed material. In some embodiments, the third solvent extraction stage feed material may have a solid mineral material concentration of less than or equal to about 70 percent by weight of the third solvent extraction stage feed material. In some embodiments, the third solvent extraction stage feed material may have a solid mineral material concentration of between about 20 percent and 70 percent by weight of the third solvent extraction stage feed material.

The third solvent extraction stage feed material may include a third solvent extraction stage amount of a diluent. In some embodiments, the diluent may be comprised of or may consist essentially of a naphthenic type diluent such as naphtha and the third solvent extraction stage amount of the diluent may be at least about 10 percent by weight of the third solvent extraction stage feed material.

In some embodiments, the third solvent extraction stage may be comprised of attritioning the third solvent extraction stage feed material in order to produce an attritioned third solvent extraction stage feed material. In some embodiments, attritioning the third solvent extraction stage feed material in the third solvent extraction stage may be comprised of mixing the third solvent extraction stage feed material in a third mixing apparatus.

In some embodiments, the third solvent extraction stage may be further comprised of separating the attritioned third solvent extraction stage feed material in order to produce a third solvent extraction stage underflow component and a third solvent extraction stage overflow component. In some embodiments, separating the attritioned third solvent extraction stage feed material its the third solvent extraction stage may be comprised of passing the attritioned third solvent extraction stage feed material through a third gravity settler. In some embodiments, the third gravity settler may be comprised of a third gravity settling vessel.

In some embodiments, the second solvent extraction process may consist essentially of the first solvent extraction stage, the second solvent extraction stage and the third solvent extraction stage. In such embodiments, the debitumenized heavy mineral concentrate may be comprised of or may consist essentially of the third solvent extraction stage underflow component. In such embodiments, the second extract may be comprised of or may consist essentially of the first solvent extraction stage overflow component and/or the second solvent extraction stage overflow component and/or the third solvent extraction stage overflow component.

In some embodiments, the first solvent extraction stage, the second solvent extraction stage and the third solvent extraction stage may be arranged in a countercurrent configuration. In such embodiments, the second extract may be comprised of or may consist essentially of the first solvent extraction stage overflow component. In such embodiments, the first solvent extraction stage feed material, may be further comprised of the second solvent extraction stage overflow component, and the second solvent extraction stage feed material may be further comprised of the third solvent extraction stage overflow component.

The diluent may be composed of a hydrocarbon diluent that is introduced to the second solvent extraction process and/or the diluent may be comprised of residual froth treatment diluent which is contained in the both treatment tailings as a result of the both treatment process. The hydrocarbon diluent may be introduced to the second solvent extraction process in any manner which is effective to provide a suitable amount of the diluent to the second solvent extraction process and/or the stages of the second solvent extraction process.

In some embodiments, the hydrocarbon diluent may consist essentially of a naphthenic type diluent. In some embodiments, the hydrocarbon diluent may be comprised of a naphthenic type diluent and may be further comprised of a paraffinic type diluent so that the hydrocarbon diluent is a mixture of a naphthenic type diluent and a paraffinic type diluent.

In some embodiments, the diluent (comprising the hydrocarbon diluent and the froth treatment diluent) may consist essentially of a naphthenic type diluent. In some embodiments, the diluent may be comprised of a naphthenic type diluent and may be further comprised of a paraffinic type diluent so that the diluent is a mixture of a naphthenic type diluent and a paraffinic type diluent.

In some embodiments, an addition amount of a naphthenic type diluent as a hydrocarbon diluent may be combined with the heavy mineral concentrate, the first solvent extraction stage underflow component, and/or the second solvent extraction stage underflow component.

In some embodiments in which the solvent extraction stages of the second solvent extraction process are arranged in a countercurrent configuration, subjecting the heavy mineral concentrate to second solvent extraction process may be comprised of combining an addition amount of a hydrocarbon diluent with the second solvent extraction stage underflow component so that the third solvent extraction stage feed material is comprised of the second solvent extraction stage underflow component and the addition amount of the hydrocarbon diluent. In some embodiments, the addition amount of the hydrocarbon diluent may be selected so that the first solvent extraction stage amount of the diluent is at least about 10 percent by weight of the first solvent extraction stage feed material.

Second Solvent Extraction Process—Intra-Stage Recycling

In some embodiments, any stage or stages of the second solvent extraction process may further comprise producing an intermediate component produced between an overflow zone and an underflow zone of a gravity settler and recycling the intermediate component to the solvent extraction stage so that the feed material for the solvent extraction stage is further comprised of the recycled amount of the intermediate component. In embodiments, the ratio of the recycled amount of the intermediate component to the feed material for the solvent extraction stage is in a range of between about 0.1 to about 0.9, and more particularly between about 0.25 to 0.5.

Second Solvent Extraction Process—Inter-Stage Differential Underflow Withdrawal Rate In some embodiments where the second solvent extraction process comprises passing the froth treatment tailings through a plurality of stages of a plurality of solvent extraction apparatus each producing an underflow component and an overflow component, the second solvent extraction process may be further comprised of withdrawing the underflow component from an earlier stage at a greater rate than withdrawing the underflow component from a later stage. In embodiments, the ratio of the withdrawal rate of the underflow component from the later stage to the withdrawal rate of the underflow component from the earlier stage is in the range of between about 0 to about 1, and more particularly in the range of between about 0.05 to about 0.5.

Diluent Recovery Process

The method of the invention may be further comprised of one or more recovery processes for recovering an amount of the diluent from an "intermediate product", which refers to one or a combination of the fine mineral material fraction, the coarse mineral material tailings, and the debitumenized heavy mineral concentrate. Recovering the amount of the diluent from the intermediate product may be achieved in any manner which is effective to reduce the diluent concentration of the intermediate product and thereby produce a recovered diluent and a diluent recovered intermediate product.

In some embodiments, recovering an amount of diluent from the intermediate product may comprise introducing an intermediate product into a diluent recovery vessel so that it forms an intermediate product pool in the diluent recovery vessel, introducing an amount of steam directly into the intermediate product pool, mixing the dilated intermediate product that is contained in the intermediate product pool, and maintaining the diluted intermediate product in the diluent recovery vessel for a residence time. The method of recovering the diluent from the intermediate product and the diluent recovery vessel may be in accordance with the teachings in Canadian Patent No. 2,768,852 (Moran et al.), the contents of which are herein incorporated by reference.

More than one intermediate product may be introduced into a single diluent recovery vessel, or different intermediate products may be introduced into different diluent recovery vessels. In some embodiments, the fine mineral material fraction and the coarse mineral material tailings may be processed together in a first diluent recovery vessel to recover an amount of diluent therefrom, while the debitumenized heavy mineral concentrate may be processed in a second diluent recovery vessel to recover another amount of diluent therefrom.

Water Recovery Process

In some embodiments, the method further comprises a water recovery process to recover water from the froth treatment tailings. The recovered wafer may be reused in the process for recovering bitumen from oil sand ore, and/or may be used to recover heat from the process for recovering bitumen from oil sand ore.

In embodiments, the water recovery process may comprise adding a flocculant, such as a polymer flocculant, to the diluent recovered intermediate product, and subjecting the resultant mixture of flocculated solids and diluent recovered intermediate product to an enhanced gravity separation process to produce the recovered water portion and the thickened slurry therefrom. In embodiments, the recovered water portion may be recovered in elevated temperatures and recycled to the process for recovering bitumen from oil sands. The water recovery process may further comprise subjecting the thickened slurry to rim ditching or beaching to recover additional water.

Recovery Performance

In some embodiments, the method of the invention may be capable of recovering a very large amount of the bitumen from the froth treatment tailings, such that the first extract and the second extract collectively contain substantially all of the bitumen, while the debitumenized heavy mineral concentrate contain a negligible amount of the bitumen. In one embodiment, the amount of bitumen recovered in the first extract and the second extract, collectively, is greater than 85 percent, and mom particularly greater than about 95 percent by mass of the bitumen in the froth treatment tailings. In one embodiment, the amount of bitumen in the debitumenized heavy mineral concentrate is less than 1 percent, and more particularly, less than about 0.1 percent by mass of the bitumen in the froth treatment tailings.

BRIEF DESCRIPTION OF DRAWINGS

Embodiments of the invention will now be described with reference to the accompanying drawings, in which:

FIGS. 2A-2G are collectively a material balance for a laboratory bench scale experiment with respect to an embodiment of the method of the invention similar to that depicted in FIG. 1, conducted on a froth treatment tailings, using naphtha as a hydrocarbon diluent, wherein the froth treatment tailings are comprised of an amount of naphtha as a froth treatment diluent.

DETAILED DESCRIPTION

Figure 1:
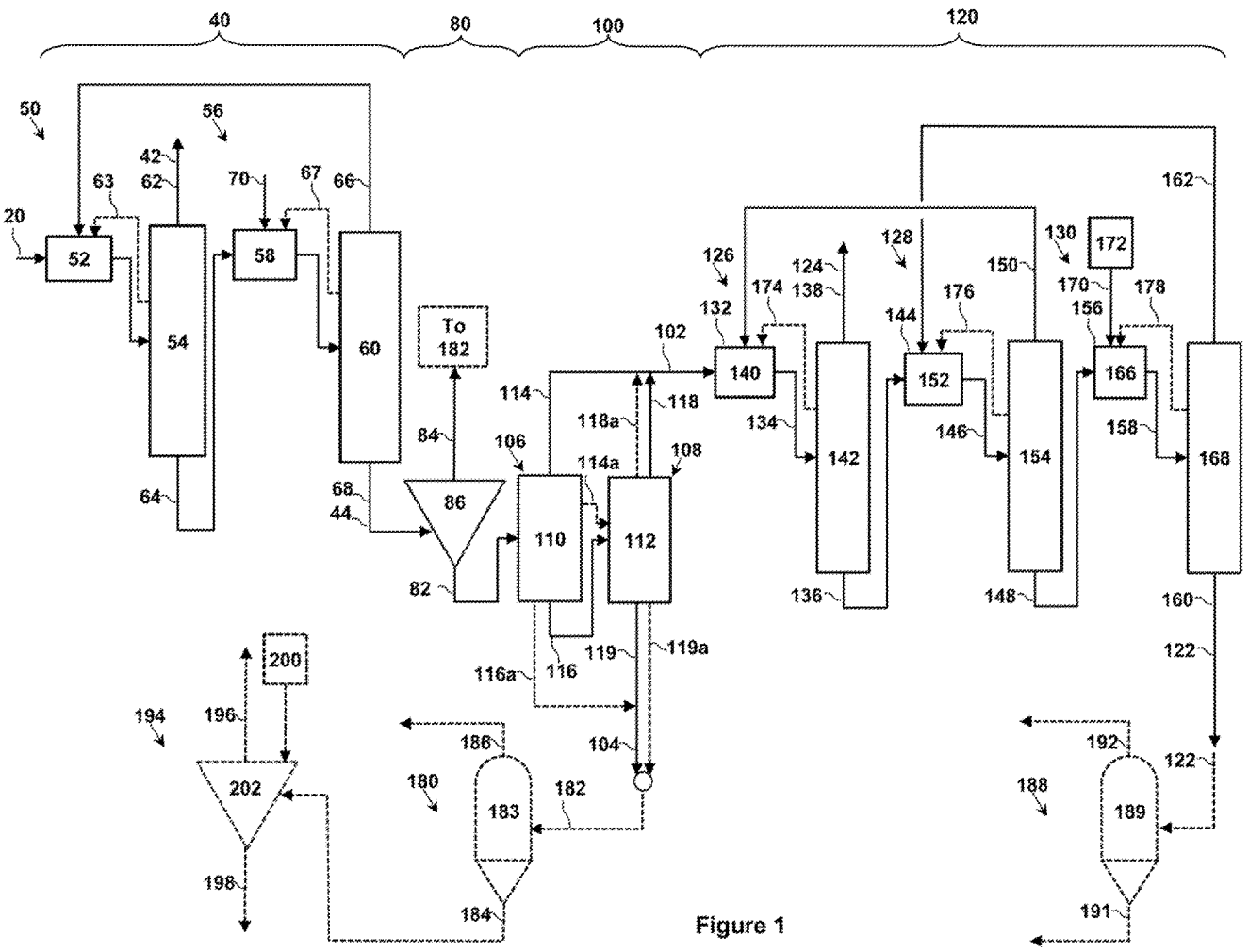
FIG. 1 is schematic process flow diagram depicting an embodiment of the system of the invention used to implement an embodiment of the method of the invention, including depictions of alternate and/or optional features of the embodiment of the invention in dashed lines.

Referring to FIG. 1, a non-limiting exemplary embodiment of the method of the present invention is depicted schematically in a process flow diagram. The method is for processing froth treatment tailings in order to recover bitumen, diluent, and water therefrom, and to produce a diluent recovered debitumenized heavy mineral concentrate therefrom.

A process for recovering bitumen from oil sand is comprised of producing a bitumen froth from the oil sand (not shown), and is further comprised of processing the bitumen froth in a froth treatment process (not shown) in order to separate froth treatment tailings (20) from the bitumen froth. The resulting froth treatment tailings (20) comprise solid mineral material, water and bitumen. In this exemplary embodiment, the froth treatment tailings (20) also comprise an amount of a naphthenic type froth treatment diluent which is used in the froth treatment process. The solid mineral material includes coarse mineral material and fine mineral material. A large proportion of the heavy minerals in the froth treatment tailings (20) are typically present as coarse mineral material in the froth treatment tailings (20). The tine mineral material which is included in the froth treatment tailings (20) does not typically contain significant amounts of heavy minerals.

First Solvent Extraction Process (40)

In the exemplary embodiment shown in FIG. 1, the froth treatment tailings (20) is subjected to a first solvent extraction process (40) in order to produce a first extract (42) and a fast raffinate (44). The first solvent extraction process (40) is performed using two stages of solvent extraction apparatus that are arranged in a countercurrent configuration. The first solvent extraction stage apparatus (50) of the first solvent extraction process (40) comprises a first mixer (52) and a first gravity settler (54). The second solvent extraction stage apparatus (56) of the first solvent extraction process (40) comprises a second mixer (58) and a second gravity settler (60). As depicted in FIG. 1, each of the gravity settlers (54, 60) comprises a gravity settling vessel.

The froth treatment tailings (20) are delivered to the first mixer (52) for mixing and are then delivered to the first gravity settler (54) in order to produce a first solvent extraction stage overflow product (62), and a first solvent extraction stage underflow product (64).

The first solvent extraction stage extraction overflow product (62) is the first extract (42). The first extract (42) is comprised of solid mineral material, water, and a first extract amount of the bitumen. The first extract (42) is also comprised of an amount of the froth treatment diluent from the froth treatment tailings (20) and an amount of the hydrocarbon diluent (70) that is present in the first extract (42) as a result of the recycling of the second solvent extraction stage overflow product (66) to the first mixer (52), as described below. The first extract (42) has a solid mineral material concentration by weight and a water concentration by weight (collectively referred to as the "BS&W content"). If the solid mineral material concentration, the water concentration and the BS&W content in the first extract (42) are below acceptable limits, the first extract (42) may be suitable for further processing and/or transport as a diluted bitumen (i.e., dilbit) product. The further processing of the first extract (42) may be comprised of subjecting the first extract (42) to a solvent recovery process for recovering substantially all or a portion of the froth treatment diluent and the hydrocarbon diluent (70) therefrom. If, however, the solid mineral material concentration and/or the water concentration by weight in the first extract (42) are above acceptable limits, the first extract (42) may be subjected to clarifying (not shown) in order to produce a clarified extract (not shown) which has a reduced solid mineral material concentration by weight and/or water concentration by weight in comparison with the first extract (42).

Referring to the exemplary embodiment shown in FIG. 1, a recycled amount of a first solvent extraction stage intermediate component (63) may optionally be combined with the froth treatment tailings (20) so that the first solvent extraction stage feed material in the first mixer (52) is further comprised of the recycled amount of the first solvent extraction stage intermediate component (63). The first solvent extraction stage intermediate component (63) is withdrawn from the first gravity settler (54) at a withdrawal point that is located below the level in the first gravity settler (54) where the first solvent extraction stage overflow component (62) accumulates, and that is located above the level in the first gravity settler (54) where the first solvent extraction stage underflow component (64) accumulates. The ratio by weight of the recycled amount of the first solvent extraction stage intermediate component (63) to the total amount of the first solvent extraction stage feed material in the first mixer (52) may be in the range of between about 0.1 to about 0.9, and more particularly in the range of between about 0.25 to 0.5.

The first solvent extraction stage underflow product (64) is delivered to the second mixer (58) for mixing and is then delivered to the second gravity settler (60) in order to produce a second solvent extraction stage overflow product (66), and a second solvent extraction stage underflow product (68). The second solvent extraction stage overflow product (66) is recycled to the first mixer (52).

An amount of a hydrocarbon diluent (70) is also delivered to the second mixer (58) for mixing with the first solvent extraction stage underflow product (64). In embodiments, the weight ratio of the amount of hydrocarbon diluent (70)

that is delivered to the second mixer (58) to the amount of froth treatment tailings (20) may be in range of about 0.3 to 0.5.

The hydrocarbon diluent (70) is selected having regard to the composition of the froth treatment diluent. In the embodiment of FIG. 1, the hydrocarbon diluent (70) and the froth treatment diluent are comprised of a single naphthenic type diluent. In other embodiments, the hydrocarbon diluent (70) may be selected from a naphthenic type diluent (e.g., naphtha, or Jet B aviation fuel specification comprising an aromatic content of up to 20 percent by volume) and a paraffinic type diluent (e.g., varnish maker's and painters naphtha (VM & P) naphtha comprising an aromatic content of less than 1 percent by volume, pentane, or hexane). (As is known in the art, besides aromatic compounds, naphthenic type diluents and paraffinic type diluent may also comprise paraffins, olefins and naphthalenes.) In embodiments where the bitumen in the froth treatment tailings comprises a combination of an asphaltene enriched bitumen (AEB) component and a non-asphaltenic component (e.g., maltene), the type of hydrocarbon diluent (70) may be selected to selectively recover either the AEB component or the maltene component, or a desired proportion of both the AEB component and the maltene component. The naphthenic type diluent may be selected when it is desired to recover both the AEB component and the maltene component. The paraffinic type diluent may be selected when it is desired to recover the maltene component in preference to the AEB component.

Referring to the exemplary embodiment shown in FIG. 1, a recycled amount of a second solvent extraction stage intermediate component (67) may optionally be combined with the first solvent extract stage underflow product (64) and the hydrocarbon diluent (70) so that the second solvent extraction stage feed material in the second mixer (58) is further comprised of the recycled amount of the second solvent extraction stage intermediate component (67). The second solvent extraction stage intermediate component (67) is withdrawn from the second gravity settler (60) at a withdrawal point which is located below the level in the second gravity settler (60) where the second solvent extraction stage overflow component (66) accumulates and which is located above the level in the second gravity settler (60) where the second solvent extraction stage underflow component (68) accumulates. The ratio by weight of the recycled amount of the second solvent extraction stage intermediate component (67) to the total amount of the second solvent extraction stage feed material in the second mixer (58) may be in the range of between about 0.1 to about 0.9, and more particularly in the range of between about 0.25 to about 0.5.

In some embodiments, the second solvent extraction stage underflow product (68) may be withdrawn from the second gravity settler (60) at a rate that is less than the rate at which the first solvent extraction stage underflow product (64) is withdrawn from the first gravity settler (54). In embodiments, the ratio of the withdrawal rate of the second solvent extraction stage underflow product (68) to the withdrawal rate of the first solvent extraction stage underflow product (64) is in the range of between about 0 to about 1, and more particularly in the range between about 0.05 to about 0.5.

The second solvent extraction stage underflow product (68) is the first raffinate (44) and is subjected to further processing in the separation process (80), as described below.

Separation Process (80)

In the exemplary embodiment shown in FIG. 1, the method comprises subjecting the first raffinate (44) to a separation process (80) in order to produce a coarse mineral material fraction (82) that comprises the coarse solid mineral material and a fine mineral material fraction (84) that comprises the fine solid mineral material. In the exemplary embodiment depicted in FIG. 1, the separation process (80) comprises subjecting the first raffinate (44) to enhanced gravity separation by passing the first raffinate (44) through an enhanced gravity separation apparatus (86) such as a hydrocyclone.

The fine mineral material fraction (84) may be further processed in order to recover diluent therefrom in the first diluent recovery process (180), as described below. The coarse mineral material fraction (82) is subjected to further processing in the froth flotation process (100), as described below.

Froth Flotation Process (100)

The coarse mineral material fraction (84) is subjected to froth flotation process (100) in order to produce a heavy mineral concentrate (102) and a coarse mineral material tailings (104) therefrom. A purpose of the froth flotation process (100) is to concentrate the heavy minerals by rejecting the coarse mineral material tailings (104) in order to produce the heavy mineral concentrate (102). The heavy mineral concentrate (102) has a substantially smaller volume than the coarse mineral material fraction (44) and can therefore be processed more efficiently than the coarse mineral material fraction (44).

In the exemplary embodiment depicted in FIG. 1, the froth flotation process (100) is comprised of a first froth flotation stage (106) and a second froth flotation stage (108). As depicted in FIG. 1 the first froth flotation stage (106) is performed in a first flotation vessel (110) and the second froth flotation stage (108) is performed in a second flotation vessel (112).

In the exemplary embodiment depicted in FIG. 1, both the first froth flotation stage (106) and the second froth flotation stage (108) are performed in the presence of a suitable amount of an injected gas such as air (not shown) and in the presence of a suitable amount of a suitable frothing agent (not shown). Non-limiting examples of potentially suitable frothing agents include glycol based frothers and/or alcohol based bothers. As a specific non-limiting example, a suitable frothing agent may be Cytec™ F-507 frother, a product of Cytec Industries Inc., and may be added to the feed material to provide a frothing agent concentration of between about 15 grams and about 50 grams per tonne of feed material in each of the froth flotation stages (106, 108).

The froth flotation stages (106, 108) may be arranged in a scavenging configuration or in a cleaning configuration. The scavenging configuration of the froth flotation process (100) is depicted by solid lines in FIG. 1. The cleaning configuration of the froth flotation process (100) is depicted by dashed lines in FIG. 1.

In the scavenging configuration of the froth flotation process (100) the first froth flotation stage (106) is a rougher froth flotation stage and the second froth flotation stage (108) is a scavenger froth flotation stage so that subjecting the coarse mineral material fraction (82) to both flotation process (100) is comprised of subjecting the coarse mineral material fraction (82) to the rougher froth flotation stage in order to produce a rougher stage float product (114) and a rougher stage sink product (116), and is further comprised of subjecting the rougher stage sink product (116) to the scavenger froth flotation stage in order to produce a scavenger stage float product (118) and a scavenger stage sink product (119).

In the scavenging configuration of the froth flotation process (100) as depicted in FIG. 1, the rougher stage float product (114) and the scavenger stage float product (118) are combined so that the heavy mineral concentrate (102) is comprised of or consists essentially of the rougher stage float product (114) and the scavenger stage float product (118), while the coarse mineral material tailings (104) are comprised of or consist essentially of the scavenger stage sink product (119).

In the scavenging configuration of the froth flotation process (100), subjecting the rougher stage sink product (116) to the scavenger froth notation stage may be comprised of adding an amount of a collector (not shown) to the rougher stage sink product (116) in order to enhance the recovery of heavy minerals in the scavenger stage float product (118). As a specific non-limiting example, the collector may be comprised of a hydrocarbon liquid such as kerosene, naphtha or a mixture thereof. It is believed that, the collector adheres to heavy minerals which have amounts of bitumen attached thereto, thereby increasing the hydrophobicity and floatabillty of the heavy minerals.

In the scavenging configuration of the froth flotation process (100), the rougher froth flotation stage and the scavenger froth flotation stage are performed so that the residence time of the coarse mineral material fraction (82) in the rougher froth flotation stage (106) is longer than the residence time of the rougher stage sink product (116) in the scavenger froth flotation stage (108). For example, in some applications of the method of the invention, the residence time of the coarse mineral material fraction (82) in the rougher froth flotation (106) stage may be about 10 minutes, while the residence time of the rougher stage sink product (116) in the scavenger froth flotation stage (108) may be about 5 minutes.

In the cleaning configuration of the froth flotation process (100), the first froth flotation stage (106) is a rougher froth flotation stage and the second froth flotation stage (108) is a cleaner froth flotation stage so that subjecting the coarse mineral material fraction (82) to froth flotation process (100) is comprised of subjecting the coarse mineral material fraction (82) to the rougher froth flotation stage in order to produce a rougher stage float product (114*a*) and a rougher stage sink product (116*a*), and is further comprised of subjecting the rougher stage float product (114*a*) to the cleaner froth flotation stage in order to produce a cleaner stage float product (118*a*) and a cleaner stage sink product (119*a*).

In the cleaning configuration of the froth flotation process (100) as depicted in FIG. 1, the heavy mineral concentrate (102) is comprised of or consists essentially of the cleaner stage float product (118*a*). Furthermore, in the cleaning configuration of the froth flotation process (100) as depicted in FIG. 1, the rougher stage sink product (116*a*) and the cleaner stage sink product (119*a*) are combined so that she coarse mineral material tailings (104) are comprised of or consist essentially of the rougher stage sink product (116*a*) and the cleaner stage sink product (119*a*).

In the embodiments of both the scavenging configuration and the cleaning configuration of the froth flotation process (100) as described above, the coarse mineral material fraction (44) may have a solid mineral material concentration of between about 20 percent and about 30 percent by weight of the coarse mineral material fraction (44) when the coarse mineral material fraction (44) is introduced to the froth notation process (100) or more particularly, when the coarse mineral material fraction (44) is introduced to the first froth flotation stage (106).

Second Solvent Extraction Process (120)

The heavy mineral concentrate (102) is subjected to a second solvent extraction process (120) in order to produce a debitumenized heavy mineral concentrate (122) and a second extract (124) therefrom.

In the embodiment depicted in FIG. 1, the second solvent extraction process (120) is comprised of a first solvent extraction stage (126), a second solvent extraction stage (128) and a third solvent extraction stage (110).

In the exemplary embodiment shown in FIG. 1, the solvent extraction stages (126, 128, 130) are arranged in a countercurrent configuration. As a result, the second extract (124) is produced from the first solvent extraction stage (126) and the debitumenized heavy mineral concentrate (122) is produced from the third solvent extraction stage (130).

The first solvent extraction stage (126) is comprised of attritioning a first solvent extraction stage feed material (132) in order to produce an attritioned first solvent extraction stage feed material (134). The first solvent extraction stage (126) is further comprised of separating the attritioned first solvent extraction stage feed material (134) in order to produce a first solvent extraction stage underflow component (136) and a first solvent extraction stage overflow component (138).

The first solvent extraction stage feed material (132) is comprised of the heavy mineral concentrate (102) and includes a first solvent extraction stage amount (not shown) of a diluent. In a specific application of the embodiment of FIG. 1, the diluent consists essentially of naphtha and the first sol vent extraction stage amount of the diluent is at least about 15 percent by weight of the first solvent extraction stage feed material (132).

In the exemplary embodiment shown in FIG. 1, the diluent may be comprised of a hydrocarbon diluent which is added in the practice of the invention and/or the diluent may be comprised of a froth treatment diluent which was present in the froth treatment tailings (20) as a result of a froth treatment process.

In the exemplary embodiment shown in FIG. 1, the first solvent extraction stage feed material (132) may have a solid mineral material concentration of between about 10 percent and about 70 percent by weight of the first solvent extraction stage feed material (132). The first solvent extraction stage feed material (132) may be comprised of art amount of make-up water (not shown) to provide a desired solid mineral material concentration for the first solvent extraction stage feed material (132). The make-up water (not shown) may be comprised of or may consist essentially of fresh water and/or water which is recycled from the method of the invention or from other processes.

In the exemplary embodiment shown in FIG. 1, the attritioning of the first solvent extraction stage feed material (132) is performed by mixing the first solvent extraction stage feed material (132) in a first mixing apparatus (140). A purpose of the attritioning is to liberate bitumen from the heavy mineral concentrate (102) so that the bitumen can more effectively be separated from the heavy minerals in the separating of the attritioned first solvent extraction stage feed material (132). Another purpose of the attritioning is to mix the constituents of the first solvent extraction stage feed material (132).

In the exemplary embodiment shown in FIG. 1, the separating of the attritioned first solvent extraction stage feed material (132) is performed by passing the attritioned first solvent extraction stage feed material (132) through a first gravity settler (142). In the embodiment of FIG. 1, the fast gravity settler (142) is comprised of a first gravity settling vessel.

In the exemplary embodiment shown in FIG. 1, the second extract (124) is comprised of or consists essentially of the first solvent extraction stage overflow component (138). In the embodiment, of FIG. 1, the first solvent extraction stage underflow component (136) is subjected to the second solvent extraction stage (128).

The second solvent extraction stage (128) is comprised of attritioning a second solvent extraction stage feed material (144) in order to produce an attritioned second solvent extraction stage feed material (146). The second solvent extraction stage (128) is further comprised of separating the attritioned second solvent extraction stage feed material (146) in order to produce a second solvent extraction stage underflow component (148) and a second solvent extraction stage overflow component (150).

The second solvent extraction stage feed stage material (144) is composed of the first solvent extraction stage underflow component (136) and includes a second solvent extraction stage amount of a diluent. In the embodiment of FIG. 1, the diluent consists essentially of naphtha. In the embodiment of FIG. 1, the second solvent extraction stage amount of the diluent is at least about 15 percent by weight of the second solvent extraction stage feed material (144). In the embodiment of FIG. 1, the diluent may be comprised of a hydrocarbon diluent which is added in the practice of the invention and/or the diluent may be comprised of a froth treatment diluent which was present in the froth treatment tailings (20).

In the exemplary embodiment shown in FIG. 1, the second solvent extraction stage feed material (144) may have a solid mineral material concentration of between about 20 percent and about 70 percent by weight of the second solvent extraction stage feed material (144).

In the exemplary embodiment shown in FIG. 1, the attritioning of the second solvent extraction stage feed material (144) is performed by mixing the second solvent extraction stage feed material (144) in a second mixing apparatus (152). A purpose of the attritioning is to liberate bitumen from the second solvent extraction stage feed material (144) so that the bitumen can more effectively be separated from the heavy minerals in the separating of the attritioned second solvent extraction stage teed material (146). Another purpose of the attritioning is to mix the constituents of the second solvent extraction stage feed material (144).

In the exemplary embodiment shown in FIG. 1, the separating of the attritioned second solvent extraction stage feed material (146) is performed by passing the attritioned second solvent extraction stage feed material (146) through a second gravity settler (154). In the embodiment of FIG. 1, the second gravity settler (154) is comprised of a second gravity settling vessel.

In the exemplary embodiment shown in FIG. 1, the second solvent extraction stage overflow component (150) is mixed with the heavy mineral concentrate (102) in the first mixing apparatus (140) so that the first solvent extraction stage feed material (132) is comprised of the second solvent extraction stage overflow component (150). In the embodiment of FIG. 1, the second solvent extraction stage underflow component (148) is subjected to the third solvent extraction stage (130).

The third solvent extraction stage (130) is comprised of attritioning a third solvent extraction stage feed material (156) in order to produce an attritioned third solvent extraction stage feed material (158). The third solvent extraction stage (130) is further comprised of separating the attritioned third solvent extraction stage feed material (158) in order to produce a third solvent extraction stage underflow component (160) and a third solvent extraction stage overflow component (162).

The third solvent extraction stage feed material (156) is comprised of the second solvent extraction stage underflow component (148) and includes a third stage amount of a diluent. In the embodiment of FIG. 1, the diluent consists essentially of naphtha. In the embodiment of FIG. 1, the third stage amount of the diluent is at least about 15 percent by weight of the third solvent extraction stage feed material (156). In the embodiment of FIG. 1, the diluent may be further comprised of a hydrocarbon diluent which is added in the practice of the invention and/or the diluent may be comprised of a froth treatment diluent which was present in the froth treatment tailings (20).

In the exemplary embodiment shown in FIG. 1, the third solvent extraction stage feed material (156) may have a solid mineral material concentration of between about 20 percent and about 70 percent by weight of the third solvent extraction stage feed material (156).

In the exemplary embodiment shown in FIG. 1, the attritioning of the third solvent extraction stage feed material (156) is performed by mixing the third solvent extraction stage feed material (156) in a third mixing apparatus (166). A purpose of the attritioning is to liberate bitumen from the third solvent extraction stage feed material (156) so that the bitumen can more effectively be separated from the heavy minerals in the separating of the attritioned third solvent extraction stage feed material (158). Another purpose of the attritioning is to mix the constituents of the third solvent extraction stage feed material (156).

In the exemplary embodiment shown in FIG. 1, the separating of the attritioned third solvent extraction stage feed material (158) is performed by passing the attritioned third solvent extraction stage feed material (158) through a third gravity settler (168). In the embodiment of FIG. 1, the third gravity settler (168) is comprised of a third gravity settling vessel.

In the exemplary embodiment shown in FIG. 1, the third solvent extraction stage overflow component (162) is mixed with the first solvent extraction stage underflow component (136) in the second mixing apparatus (152) so that the second solvent extraction stage feed material (144) is comprised of the third solvent extraction stage overflow component (162). In the embodiment of FIG. 1, the debitumenized heavy mineral concentrate (122) is comprised of or consists essentially of the third solvent extraction stage underflow component (160).

In the exemplary embodiment shown in FIG. 1, an addition amount (170) of a hydrocarbon diluent (172) is combined with the second solvent extraction stage underflow component (148) so that the third solvent extraction stage feed material (156) is comprised of the addition amount (170) of the hydrocarbon diluent. In the embodiment of FIG. 1, the hydrocarbon diluent (170) consists essentially of naphtha. In the embodiment of FIG. 1, the addition amount (170) of the hydrocarbon diluent (172) is selected so that the first solvent extraction stage amount of the diluent is at least about 15 percent by weight of the first solvent extraction stage feed material (132).

The first solvent extraction stage (126) may optionally be further comprised of combining a recycled amount of an intermediate component which is derived from the solvent extraction stage feed material with the feed material so that the feed material is further comprised of the recycled amount of the intermediate component. A purpose of this optional feature is to dilute the solvent extraction stage feed material in order to enhance the separation of the feed material in the second solvent extraction process (120). This optional feature is depicted by dashed lines in FIG. 1. One or more of the solvent extraction stages (126, 128, 130) may be further comprised of this optional feature.

Referring to the exemplary embodiment shown in FIG. 1, a recycled amount of a first solvent extraction stage intermediate component (174) may optionally be combined with me heavy mineral concentrate (102) so that the first solvent extraction stage feed material (132) is further computed of the recycled amount of the first solvent extraction stage intermediate component (174). The first solvent extraction stage intermediate component (174) is withdrawn from the first gravity settler (142) at a withdrawal point which is located below the level in the first gravity settler (142) where the first solvent extraction stage overflow component (138) accumulates and which is located above the level in the first gravity settler (142) where the first solvent extraction stage underflow component (136) accumulates. The ratio by weight of the recycled amount of the first solvent extraction stage intermediate component (174) to the total amount of the first solvent extraction stage feed material (132) may be in the range of between about 0.1 to about 0.9, and more particularly in the range of between about 0.25 to 0.5.

Referring to the exemplary embodiment shown in FIG. 1, a recycled amount of a second solvent extraction stage intermediate component (176) may optionally be combined with the first solvent extraction stage underflow component (136) so that the second solvent extraction stage feed material (144) is further comprised of the recycled amount of the second solvent extraction stage intermediate component (176). The second solvent extraction stage intermediate component (176) is withdrawn from the second gravity settler (154) at a withdrawal point which is located below the level in the second gravity settler (154) where the second solvent extraction stage overflow component (150) accumulates and which is located above the level in the second gravity settler (154) where the second solvent extraction stage underflow component (148) accumulates. The ratio by weight of the recycled amount of the second solvent extraction stage intermediate component (176) to the total amount of the second solvent extraction stage feed material (144) may be in the range of between about 0.1 to about 0.9, and more particularly in the range of between about 0.25 to about 0.5.

Referring to the exemplary embodiment shown in FIG. 1, a recycled amount of a third solvent extraction stage intermediate component (178) may optionally be combined with the second solvent extraction stage underflow component (148) so that the third solvent extraction stage feed material (156) is further comprised of the recycled amount of the third solvent extraction stage intermediate component (178). The third solvent extraction stage intermediate component (178) is withdrawn from the third gravity settler (168) at a withdrawal point which is located below the level in the third gravity settler (168) where the third solvent extraction stage overflow component (162) accumulates and which is located above the level in the third gravity settler (168) where the third solvent extraction stage underflow component (160) accumulates. The ratio by weight of the recycled amount of the third solvent extraction stage intermediate component (178) to the total amount of the second solvent extraction stage feed material (156) may be in the range of between about 0.1 to about 0.9, and more particularly in the range of between about 0.25 to about 0.5.

In some embodiments, the second solvent extraction stage underflow product (148) may be withdrawn from the second gravity settler (154) at a rate that is less than the rate at which the first solvent extraction stage underflow product (136) is withdrawn from the first gravity settler (142). Similarly, in some embodiments, the third solvent extraction stage underflow product (160) may be withdrawn from the third gravity settler (168) at a rate that is less than the rate at which the second solvent extraction stage underflow product (148) is withdrawn from the second gravity settler (154). In embodiments, the ratio of the withdrawal rate of the later solvent extraction stage underflow product (160 or 148) to the withdrawal rate of the earlier solvent extraction stage underflow product (148 or 136, respectively) is in the range of between about 0 to about 1, and more particularly in the range of between about 0.05 to about 0.5.

Following the second solvent extraction process (120), the second extract (124) may be further processed and/or may be stored or transported for further processing.

First Diluent Recovery Process (180)

Following the separation process (80), the fine mineral material fraction (84) and the coarse mineral material tailings (104) may each comprise a froth flotation diluent or a hydrocarbon diluent. Consequently, it may desirable to recover at least a portion of the diluent from one or a combination of the fine mineral material fraction (84) and the coarse mineral material tailings (104). A purpose or recovering the diluent is to facilitate recycling of the diluent before further treatment or disposal of the fine mineral material fraction (84) or the coarse mineral material tailings (104). Another purpose is to reduce potential emissions of volatile organic compounds in the diluent and potentially toxic effects of the diluent when the fine mineral material fraction (84) or the coarse mineral material tailings (104) in disposal sites (e.g. tailing ponds).

As a result, the method of the invention may optionally be further comprised of a first diluent recovery process (180) for recovering an amount of the diluent from the fine mineral material fraction (84) and the coarse mineral material tailings (104) (either individually or in combination referred to as an "first intermediate product" (182)), in order to produce a first diluent recovered intermediate product (184) and a first recovered diluent (186) therefrom. It will be understood that the first intermediate product (182) may comprise either the fine mineral material fraction (84) or the coarse mineral material tailings (104), or a combination of fine mineral material fraction (84) and the coarse mineral material tailings (104).

In the exemplary embodiment of FIG. 1, recovering an amount of the diluent from the intermediate product (182) is comprised of introducing the intermediate product (182) into a first diluent recovery vessel (183) so that it forms a first intermediate product pool in the first diluent recovery vessel (183), introducing an amount of steam directly into the first intermediate product pool, mixing the resulting first diluted intermediate product which is contained in the first intermediate product pool, and maintaining the first diluted intermediate product in the first diluent recovery vessel (183) for a residence time. The method of recovering the diluent from the first intermediate product (182) and the first diluent recovery vessel (183) may be in accordance with the teachings in Canadian Patent No. 2,768,852 (Moons et al.), the contents of which are herein incorporated by reference.

Second Diluent Recovery Process (188)

Following the second solvent extraction process (120), the debitumenized heavy mineral concentrate (122) may be further processed to recover the heavy minerals which are contained therein. The debitumenized heavy mineral concentrate (122) may have a bitumen concentration which is no greater than about 0.5 percent by weight of the debitumenized heavy mineral concentrate (122), at which level, the bitumen typically does not interfere significantly with the recovery of heavy minerals front the debitumenized heavy mineral concentrate (122).

However, the debitumenized heavy mineral concentrate (122) may have a diluent concentration which is about 5 percent or more by weight of the debitumenized heavy mineral concentrate (122). It has been found that a diluent concentration of greater than about 0.5 percent may interfere significantly with the recovery of heavy minerals from the debitumenized heavy mineral concentrate (122). Consequently, it may be desirable to reduce the diluent concentration of the debitumenized heavy mineral concentrate (122) before attempting to recover the heavy minerals therefrom.

As a result, the method of the invention may optionally further comprise a second diluent recovery process (188) for recovering an amount of the diluent from a second intermediate product (190) comprising the debitumenized heavy mineral concentrate (122) in order to produce a second diluent recovered intermediate product (191) and obtain a second recovered diluent (192) therefrom.

In the exemplary embodiment of FIG. 1, recovering an amount of the diluent from the second intermediate product (190) is comprised of introducing the second intermediate product (190) into a second diluent recovery vessel (189) so that it forms a second intermediate product pool in the diluent recovery vessel, introducing an amount of steam directly into the second intermediate product pool, mixing the resulting second diluted intermediate product that is contained in the second intermediate product pool, and maintaining the second diluted intermediate product in the second diluent recovery vessel (189) for a residence time. The method of recovering the diluent from the second intermediate product and the second diluent recovery vessel (189) may be in accordance with the teachings in Canadian Patent No. 2,768,852 (Moran et al.), the contents of which are herein incorporated by reference.

Water Recovery Process (194)

The first diluent recovered intermediate product (184) may comprise water. As a result, it may be desirable to recover at least a portion of the water from the first diluent recovered intermediate product (184), which may be recycled to the process for recovering bitumen from oil sand ore or another process. As a result, the method of the invention may be further comprised of a water recovery process (194) for recovering an amount of water from the first diluent recovered intermediate product (184) in order to produce a recovered water portion (196) and a thickened slurry (198) therefrom.

In the exemplary embodiment of FIG. 1, the water recovery process (194) comprises of adding a flocculant (200) to the diluent recovered intermediate product (184) in an enhanced gravity separator (202) (e.g., a centrifuge) to flocculate solids in the diluent recovered intermediate product (184), and then subjecting the resultant mixture of flocculated solids and diluent recovered intermediate product (184) to the enhanced gravity separation process to produce the separated water portion (196) and the thickened slurry (198) therefrom. In embodiments, the flocculant may be a polymer-based flocculant that is added to the diluent recovered intermediate product (184) in a concentration in a range of about 200 ppmw to 400 ppmw (parts per million by weight). In embodiments, the recovered water portion (196) may be recovered in elevated temperatures (e.g. about 70 degrees Celsius) and recycled to the process for recovering bitumen from oil sands.

In embodiments, the water recovery process (194) may further comprise subjecting the thickened slurry (198) to rim ditching and beaching in tailings ponds to recover additional amounts of water from the thickened slurry (198).

In embodiments, the thickened slurry (198) may be suitable for direct depositing into tailing ponds and other depositional environments. It will be appreciated that reductions in the amount of water in the thickened slurry (198) as compared with the diluent recovered intermediate product (184), may allow for reductions in the volume of material that is discharged to tailings ponds for more effective thickening processes in tailings ponds with a view to accelerating the remediation of tailings ponds.

In embodiments, the thickened slurry (198) may be suitable for directly subjecting to conventional thin-lift drying to produce trafficable deposits. The reduction in the amount of bitumen in the diluent recovered intermediate product (184) on account of a portion of the bitumen having been removed during the first solvent extraction process (40) may allow for a significant reduction (e.g., less than half) in the amount of flocculant (200) required to produce conventional mature fine tails (MFT). Without restriction to a theory, it is believed that the removal of hydrocarbons from the pre-cursors to the thickened slurry enhances the efficacy of flocculant (200) by removing organic materials that would otherwise contaminate the surface of silica and mineral particles and interfere with the desired effect of the flocculant (200) to induce particle-to-particle attachments.

EXAMPLE

Referring to FIGS. 2A-2G, collectively, a material balance is provided for a bench scale test simulating the embodiment of the invention depicted by the solid lines in FIG. 1. In FIGS. 2A-2G, all units of mass are expressed in kilograms (kg). The material balance of FIGS. 2A-2G does not include a simulation of the alternate or optional features which are depicted by the dashed lines in FIG. 1. Consequently, in the material balance of FIGS. 2A-2G, the froth flotation process (100) is arranged in a scavenging configuration, and the first solvent extraction process (40) and the second solvent extraction process (120) do not include recycling of the solvent extraction intermediate components (63, 67, 174, 176, 178).

In the test that is represented by FIGS. 2A-2G the second solvent extraction process (120) was performed by adding "fresh" naphtha as a hydrocarbon diluent in the third solvent extraction stage (130) instead of by recycling the overflow components (150, 162) from the second and third solvent extraction stages (128, 130) respectively. The overflow components (150, 162) were, however, taken into consideration in calculating the material balance of FIGS. 2A-2G. It is believed that the test represented in FIGS. 2A-2G provides a reasonably accurate simulation of the results which could be expected to be achieved if the first through third solvent extraction stages (126, 128, 130) were arranged in an actual countercurrent configuration. Referring to FIG. 2A, the first extract (42), consisting of the first solvent extraction stage overflow component (62), exhibited a water concentration of about 0.50 percent by weight of the first extract (42), exhibited a solid mineral material concentration of about 0.30 percent by weight of the first extract (42), and exhibited a combined water and solid mineral material concentration of about 0.80 percent by weight of the first extract (74).

Referring to FIG. 2A, hydrocarbon diluent (70) was added in an amount of about 2.50 kg to the forth treatment tailings (20) in the amount of about 5.00 kg and the second solvent extraction stage overflow product (66) in the amount of about 2.78 kg in the first mixer (52) for a solvent to feed ration (S/F) for the first solvent extraction process (40) of about 0.32.

In FIG. 2A, the parameter "N/B" refers to the naphtha-to-bitumen ratio (on a mass basis) and is determined by dividing the amount of naphtha by the amount of amount of bitumen material for a particular stage of the first solvent extraction process (40) (any discrepancies in the values shown in FIG. 2A attributable to rounding error).

Referring to FIGS. 2B and 2C, the concentration of heavy minerals (THM) in the solids content of the first raffinate (44) was about 25.18 percent, and the concentration of heavy minerals (THM) in the solids content of the heavy mineral concentrate (102) was about 54.66419 percent.

Referring to FIG. 2C, the mass of the coarse mineral material fraction (82) was about 2.73 kg and the mass of the heavy mineral concentrate (102) was about 3.50 kg, indicating that the froth flotation process (100) was performed to achieve a mass float of about 55 percent from the coarse mineral material fraction (82).

Referring to FIGS. 2A and 2D, the bitumen recovery of the first solvent extraction process (40) was about 0.37 kg and of the second solvent extraction process (120) was about 0.02 kg of the original 0.40 kg in the froth treatment railings (20). In other words, the bitumen recovery of the first solvent extraction process (40) is about 92.5 percent, while the bitumen recovery of the second solvent extraction process (120) is about 5 percent, for an overall bitumen recovery of about 97.5 percent.

Referring to FIG. 2D, the parameter "Asphaltenes" refers to the proportion of bitumen that is comprised of pentane-insoluble hydrocarbon material.

The parameter "N/B" refers to the naphtha-to-bitumen ratio (on a mass basis) and is determined by dividing the amount of naphtha by the amount of amount of bitumen material for a particular stage of the second solvent extraction process (120) (any discrepancies in the values shown in FIG. 2D attributable to rounding error).

The parameter "B/S" refers to the bitumen-to-solids mass ratio expressed as a percentage, and is determined by dividing the amount of bitumen by the amount of solids for a particular stage of the second solvent extraction process (120) and multiplying by 100 (any discrepancies in the values shown in FIG. 2D attributable to founding error). The parameter "B/S" reflects the quality of a produced diluted bitumen stream.

Referring to FIG. 2D, hydrocarbon diluent (170) was added in an amount of about 0.30 kg to a heavy mineral concentrate in an amount of about 1.50 kg, for a solvent to feed ratio (S/F) for the second solvent extraction process of about 0.200167.

Referring to FIG. 2D, the debitumenized heavy mineral concentrate (122), consisting of the third solvent extraction underflow component (160), exhibited a bitumen concentration of about 0.03 percent by weight of the debitumenized heavy mineral concentrate (122), exhibited a diluent concentration of about 4.49 percent by weight of the debitumenized heavy mineral concentrate (122), and exhibited a water concentration of about 71.96 percent by weight of the debitumenized heavy mineral concentrate (122).

Referring to FIG. 2D, the debitumenized heavy mineral concentrate (122) contained about 0.31 kg of about 0.32 kg, or in other words about 96.875 percent by weight of the solid mineral material which was contained in the heavy mineral concentrate (102), which suggests that none or very little of the heavy minerals which were contained in the heavy mineral concentrate (102) and which would be included in the solid mineral material were lost in the second solvent extraction process (120).

Referring to FIGS. 2C and 2D, the second extract (124) contained about 0.01993 kg (rounded to 0.02 kg in FIG. 2D) of about 0.0226 kg (rounded to 0.02 kg in FIG. 2C), or in other words about 88 percent, of the bitumen that was contained in the coarse mineral material fraction (82), indicating a bitumen recovery front the coarse mineral material fraction (82) of about 88 percent.

Referring to FIG. 2F, the diluent recovered debitumenized heavy mineral concentrate (190) exhibited a bitumen concentration of about 0.07 percent by weight of the diluent recovered debitumenized heavy mineral concentrate (190), exhibited a diluent concentration of about 0.08 percent by weight of the diluent recovered debitumenized heavy mineral concentrate (190), and exhibited a water concentration of about 74.11 percent by weight of the diluent recovered debitumenized heavy mineral concentrate (190).

Referring to FIG. 2F, the diluent recovered debitumenized heavy mineral concentrate (190) contained about 0.31 kg of about 0.31 kg, or in other words, about 100 percent of the solid mineral material which was contained in the debitumenized heavy mineral concentrate (122), suggesting that none or very little of the heavy minerals that were contained in the debitumenized heavy mineral concentrate (122) were lost in the recovery of the diluent from the debitumenized heavy mineral concentrate (122).

Referring to FIG. 2G, the diluent recovered intermediate product (184) has a solids concentration of about 15.63 percent, whereas the thickened slurry (198) has a solids concentration of about 47.58 percent. The recovered water portion (196) contained about 1.93 kg of about 2.41 kg, or in other words about 80 percent of the water contained in the diluent recovered intermediate product (184). In embodiments, the recovered water portion (196) may comprise 60 to 80 percent by weight of the water in the diluent recovered intermediate product (184). The recovered water portion (196) contained about 1.93 kg of about 3.82 kg, or in other words about 50 percent of water in the froth treatment tailings (20), if make-up water added during the overall process is disregarded. The recovered water portion (196) may be of sufficient quality for re-use as process water.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A method for processing a froth treatment tailings separated from a bitumen froth produced in a process for recovering bitumen from oil sand ore, wherein the froth treatment tailings comprises a solid mineral material, a bitumen, and water, wherein the solid mineral material comprises a coarse solid mineral material having a particle size equal to or greater than about 44 microns and a fine solid mineral material having a particle size less than about 44 microns, the method comprising:

(a) subjecting the froth treatment tailings to a first solvent extraction process comprising adding a hydrocarbon diluent to the froth treatment tailings to produce a first extract and a first raffinate; wherein the first extract comprises a first extract amount of the bitumen; and wherein the first raffinate comprises the solid mineral material, a first raffinate amount of the bitumen, and water;

wherein the bitumen in the froth treatment tailings comprises a combination of an asphaltene enriched bitumen component and a maltene component, and the method further comprises selecting a relative proportion of a naphthenic type diluent to a paraffinic type diluent in the hydrocarbon diluent to selectively vary the relative proportion of the asphaltene enriched bitumen component to the maltene component in the first extract amount of the bitumen;

(b) subjecting the first raffinate to a separation process to produce a fine mineral material fraction and a coarse mineral fraction therefrom; wherein the fine mineral material fraction comprises the fine solid mineral material; and wherein the coarse mineral material fraction comprises the coarse solid mineral material, a coarse fraction amount of the bitumen, and water;

(c) subjecting the coarse mineral material fraction to a froth flotation process to produce a heavy mineral concentrate and a coarse mineral material tailings therefrom; wherein the heavy mineral concentrate comprises a heavy mineral concentrate amount of the coarse solid mineral material, a heavy mineral concentrate amount of the bitumen, and water; and (d) subjecting the heavy mineral concentrate to a second solvent extraction process to produce a second extract and a second raffinate; wherein the second extract comprises a second extract amount of the bitumen; and wherein the second raffinate comprises a debitumenized heavy mineral concentrate.

2. The method of claim 1 wherein the first solvent extraction process comprises adding a hydrocarbon diluent to the froth treatment tailings.

3. The method of claim 2 wherein the hydrocarbon diluent is added to the froth treatment tailings in a ratio by weight within the range of about 0.3 to about 0.5.

4. The method of claim 1 wherein the method further comprises subjecting an intermediate product to a diluent recovery process to produce a recovered diluent and a diluent recovered intermediate product, wherein the intermediate product comprises either one or a combination of the fine mineral material fraction and the coarse mineral material tailings, or the debitumenized heavy mineral concentrate.

5. The method of claim 4 wherein the intermediate product comprises one or a combination of the fine mineral material fraction or the coarse mineral material tailings, and the method further comprises dewatering the diluent recovered intermediate product.

6. The method of claim 5 wherein dewatering the diluent recovered intermediate product comprises:

(a) adding a flocculant to the diluent recovered intermediate product to flocculate solids in the diluent recovered intermediate product to produce a mixture of diluent recovered intermediate product and flocculated solids; and (b) subjecting the mixture of diluent recovered intermediate product and flocculated solids to a gravity settling or enhanced gravity separation process to produce a recovered water portion and a thickened slurry therefrom.

7. The method of claim 6 wherein the flocculant comprises a polymer.

8. The method of claim 6 wherein the flocculant is added to the diluent recovered intermediate product in an amount of between about 200 ppmw to about 400 ppmw.

9. The method of claim 8 wherein the thickened slurry has a solids concentration of at least about 40 percent by weight.

10. The method of claim 6 wherein the recovered water portion is recycled to the process for recovering bitumen from oil sands.

* * * * *